US006714751B2

(12) United States Patent
Higeta et al.

(10) Patent No.: US 6,714,751 B2
(45) Date of Patent: Mar. 30, 2004

(54) CONNECTING PIN FOR PROCESS CARTRIDGE, AND PROCESS CARTRIDGE

(75) Inventors: Akira Higeta, Shizuoka (JP); Noboru Koumura, Shizuoka (JP); Ryozo Yanagisawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/990,283

(22) Filed: Nov. 23, 2001

(65) Prior Publication Data

US 2002/0064394 A1 May 30, 2002

(30) Foreign Application Priority Data

Nov. 29, 2000 (JP) ..... 2000-362520

(51) Int. Cl.[7] ..... G03G 21/18
(52) U.S. Cl. ..... 399/113
(58) Field of Search ..... 399/111, 113, 399/109; 16/380, 386, 226, 257, 259, 385; 29/525.01

(56) References Cited

U.S. PATENT DOCUMENTS 1,433,379 A * 10/1922 Kiesel, Jr. ..... 384/190.6
2,947,024 A * 8/1960 Czudak, Jr. ..... 16/228
4,345,848 A * 8/1982 Cheselka ..... 403/157
4,987,639 A * 1/1991 Baiuley et al. ..... 16/445
5,749,027 A * 5/1998 Ikemoto et al. ..... 399/113
5,774,766 A * 6/1998 Karakama et al. ..... 399/111
5,937,242 A * 8/1999 Yokoyama et al. ..... 399/114
6,185,390 B1 2/2001 Higeta et al. ..... 399/90
6,208,818 B1 * 3/2001 Noda ..... 399/111
6,236,821 B1 5/2001 Yokoyama et al. ..... 399/113
6,327,448 B1 * 12/2001 Sasaki ..... 399/111
6,481,081 B1 * 11/2002 Kilian et al. ..... 29/407.01

FOREIGN PATENT DOCUMENTS

JP 01161262 A * 6/1989 ..... G03G/15/00
JP 11-15354 1/1999

* cited by examiner

*Primary Examiner*—Robert Beatty
(74) *Attorney, Agent, or Firm*—Fitzpatrick, Cella, Harper & Scinto

(57) ABSTRACT

A connecting pin pivotally connects together the first frame and the second frame of a process cartridge including the first frame supporting an electrophotographic photosensitive drum and a second frame supporting a developing device for developing an electrostatic latent image formed on the electrophotographic photosensitive drum, and detachably mountable to the main body of an image forming apparatus. The pin is formed of a metallic hollow material, having slits defined by opposed edges of the metal material, and has formed on the metallic hollow material a restraining portion having a leading end as a bending proximal base with respect to the direction of insertion of the connecting pin and an outwardly extending trailing end.

27 Claims, 19 Drawing Sheets

CONNECTING PIN FOR PROCESS CARTRIDGE, AND PROCESS CARTRIDGE

BACKGROUND OF THE INVENTION

1. Field of the Invention

This invention relates to a process cartridge detachably mountable to an electrophotographic image forming apparatus. This invention further relates to a connecting pin for pivotally connecting two frames in the construction of the process cartridge.

The electrophotographic image forming apparatus forms an image on a recording medium by the use of the electrophotographic image forming process. Examples of the image forming apparatus include electrophotographic copiers, electrophotographic printers (such as laser beam printers and LED printers), facsimile apparatuses and word processors.

Also, the process cartridge may refer to charging means, developing means or cleaning means and an electrophotographic photosensitive drum integrally made into a cartridge which is made detachably mountable to the main body of the image forming apparatus. Alternatively, the process cartridge may refer to at least one of charging means, developing means and cleaning means and an electrophotographic photosensitive drum integrally made into a cartridge which is made detachably mountable to the main body of the image forming apparatus. Further alternatively, the process cartridge may refer to at least developing means and an electrophotographic photosensitive drum integrally made into a cartridge which is made detachably mountable to the main body of the image forming apparatus.

2. Description of the Related Art

In an image forming apparatus using the electrophotographic image forming process, there has heretofore been adopted a process cartridge into which an electrophotographic photosensitive member and process means for acting the electrophotographic photosensitive member are integrally made and which is made detachably mountable to the main body of the image forming apparatus. According to the process cartridge system, the maintenance of the apparatus can be done by a user himself without resort to a serviceman and therefore, the usability of the apparatus is markedly improved.

As a typical construction of such a process cartridge, there is one in which two frames are connected together. For example, a cleaning frame supporting a photosensitive drum, a charger and a cleaning device, and a frame comprising a developing frame supporting developing means and a toner frame having a toner chamber, the developing frame and the toner frame being joined together, are connected together for rotation about a fulcrum. The two frames are biased about the fulcrum by a resilient member such as a spring to thereby determine the relative position of the photosensitive drum and the developing means. The functional merits of adopting the above-described construction include many merits such as the optimization of the pressure force of a developing roller against the photosensitive drum, and the maintenance of the interval between the surface of the photosensitive drum and the surface of the developing roller, as well as the ease of the molding of the frames by the division into two, and the ease of assembly.

The present invention is a further development of the aforedescribed conventional art.

SUMMARY OF THE INVENTION

It is an object of the present invention to provide a connecting pin improved in connecting strength, and a process cartridge using the connecting pin.

It is another object of the present invention to provide a connecting pin difficult to pull out, and a process cartridge using the connecting pin.

It is another object of the present invention to provide a connecting pin improved in the reliability of connection, and a process cartridge using the connecting pin.

It is another object of the present invention to provide a connecting pin and a process cartridge practically using an improvement in pull-out strength, and particularly providing an improvement in strength to endure (i.e., not slipping out) vibration or shock applied thereto in the physical distribution process.

It is another object of the present invention to provide the connecting pin for a process cartridge and a process cartridge which enable stringent quality control such as periodical sampling inspection of the surface roughness and force-fit strength of the connecting pin so that a predetermined force-fit strength may be secured to be saved.

It is another object of the present invention to provide the connecting pin for a process cartridge which is formed of a metallic hollow material and a portion of which is formed with such a restraining portion that the trailing end thereof juts outwardly with the leading end thereof with respect to the direction of insertion as a bending proximal base by bending, and a process cartridge.

It is another object of the present invention to provide a process cartridge having a first frame supporting an electrophotographic photosensitive drum, a second frame supporting developing means, and a connecting pin which is formed of a metallic hollow material and a portion of which is formed with such a restraining portion that the trailing end thereof juts outwardly with the leading end thereof with respect to the direction of insertion as a bending proximal base by bending, and which pivotally fits the first frame and the second frame to each other.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Some preferred embodiments of the present invention will hereinafter be described in detail with reference to the accompanying drawings. In the following description, the widthwise direction of a process cartridge B is a direction in which the process cartridge B is mounted to and dismounted from a main body 14 of an apparatus, and aligned with a transporting direction of a recording medium. Also, the lengthwise direction of the process cartridge B is a direction intersecting with (substantially orthogonal to) the direction in which the process cartridge B is mounted to and dismounted from the main body 14 of the apparatus, and is parallel to the surface of the recording medium and is a direction intersecting with (substantially orthogonal to) the transporting direction of the recording medium. Also, the right or left with respect to the process cartridge is the right or left as viewed from above the recording medium with respect to the transporting direction of the recording medium.

Figure 1:
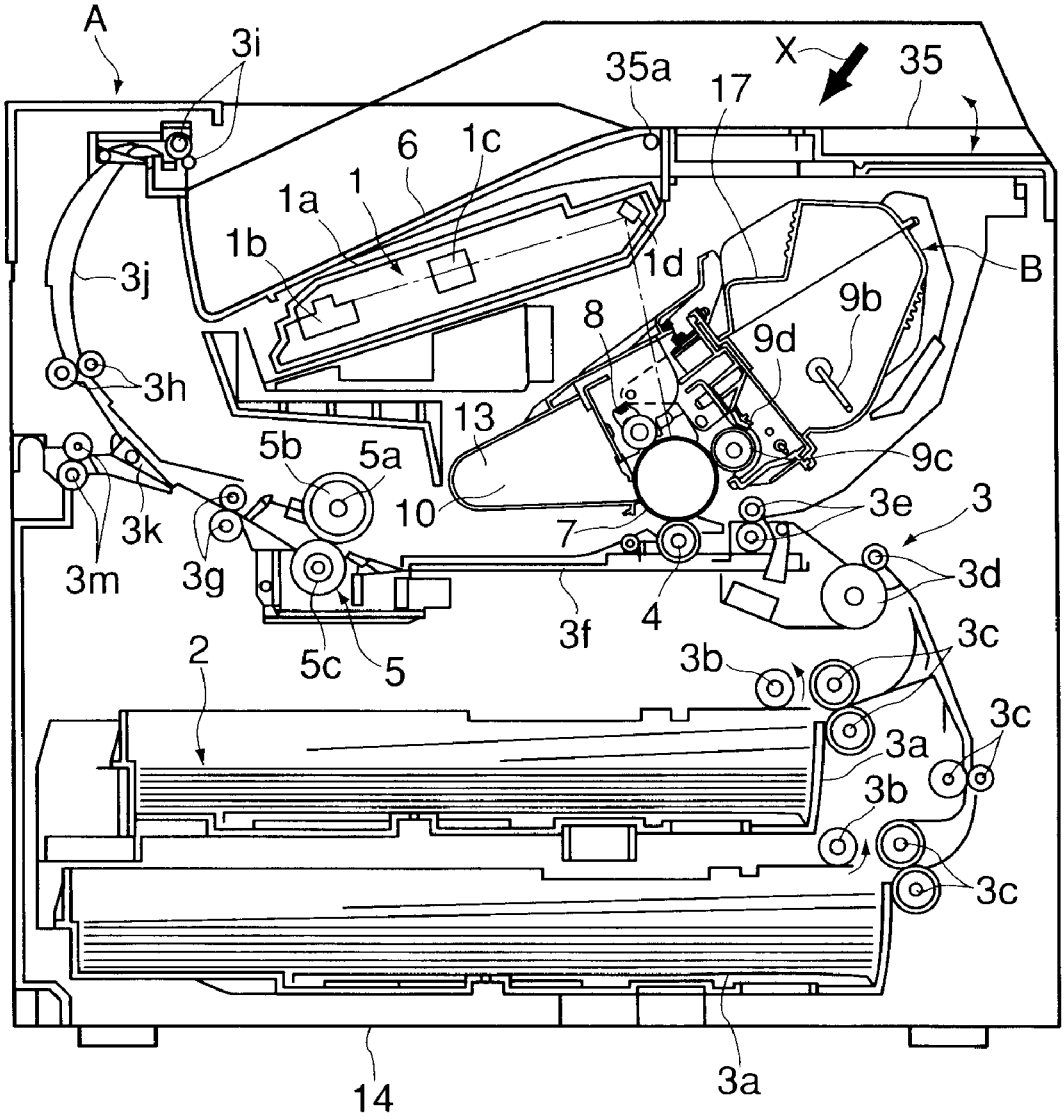
FIG. 1 is a longitudinal cross-sectional view of the main body of an image forming apparatus according to an embodiment of the present invention.
Figure 2:
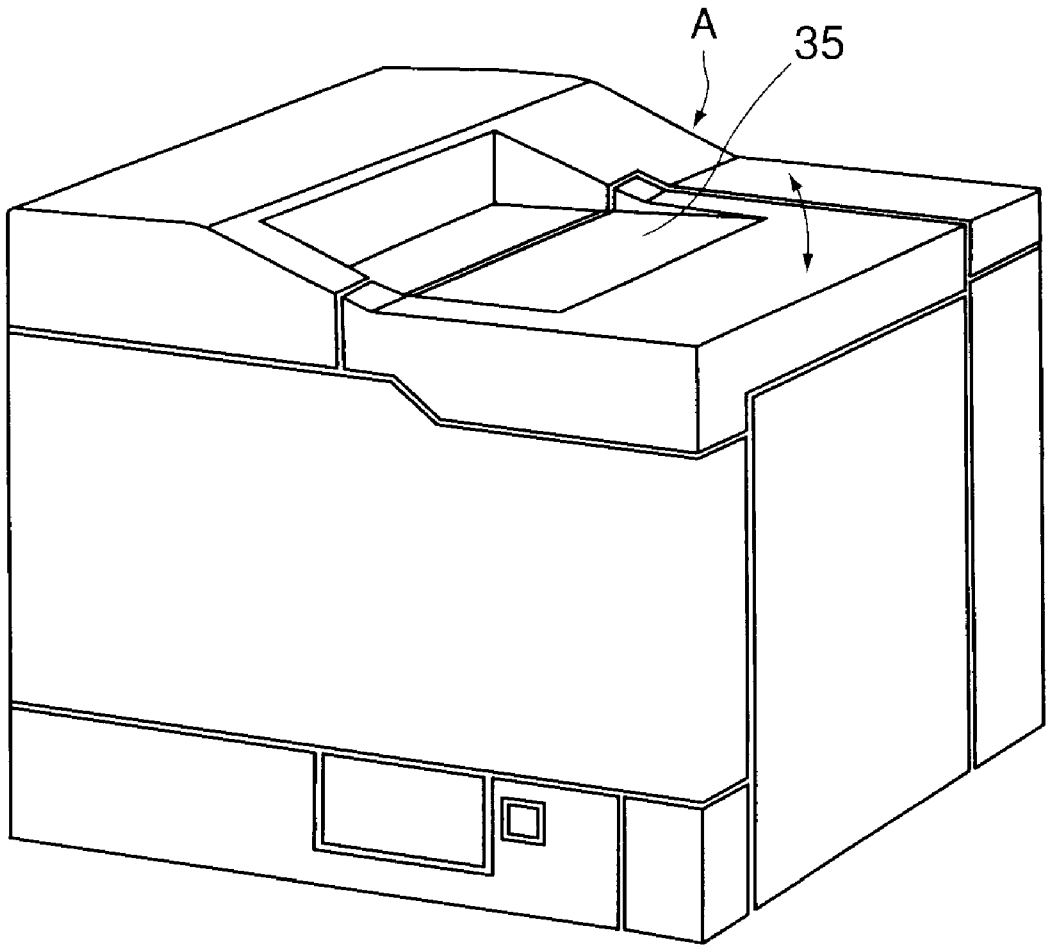
FIG. 2 is a pictorial perspective view of the main body of the image forming apparatus according to the embodiment of the present invention.

FIG. 1 is an illustration of the construction of an electrophotographic image forming apparatus (laser beam printer) to which an embodiment of the present invention is applied, and FIG. 2 is a pictorial perspective view thereof. FIGS. 3 to 6 are drawings regarding a process cartridge to which the embodiment of the present invention is applied. Also, in the following description, the upper surface of the process cartridge B is a top surface thereof in a state in which the process cartridge B is mounted to the main body 14 of the apparatus, and the lower surface thereof is a bottom surface thereof in the above-described state.

Electrophotographic Image Forming Apparatus A and Process Cartridge B

Figure 3:
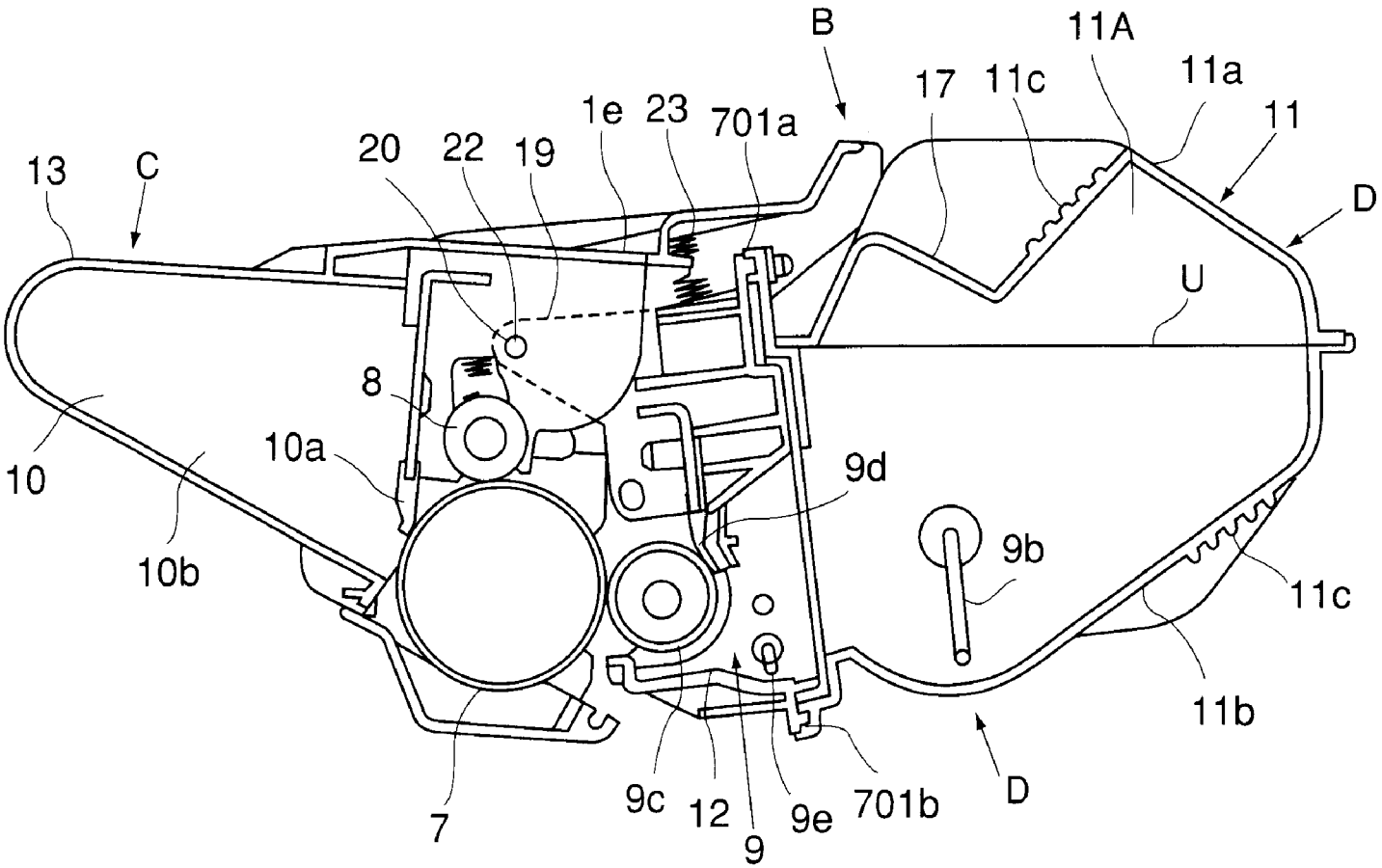
FIG. 3 is a longitudinal cross-sectional view of a process cartridge according to an embodiment of the present invention.

The laser beam printer A as the electrophotographic image forming apparatus to which the embodiment of the present invention is applied will first be described with reference to FIGS. 1 and 2. FIG. 3 shows a side cross-sectional view of the process cartridge B.

The laser beam printer A, as shown in FIG. 1, forms an image on a recording medium (such as recording paper, OHP sheet or cloth) by the electrophotographic image forming process. It forms a toner image on a drum-shaped electrophotographic photosensitive member (hereinafter referred to as the photosensitive drum). More particularly, charging is effected on the photosensitive drum 7 by charging means 8, and then a laser beam modulated in accordance with image information is applied from optical means 1 to the photosensitive drum 7 to thereby form a latent image conforming to the image information on the photosensitive drum 7. The latent image is then developed by developing means 9 to thereby form a toner image. In synchronism with the formation of the toner image, a recording medium 2 set in a feed cassette 3*a* is reversed and transported by a pickup roller 3*b*, pairs of transporting rollers 3*c* and 3*d* and a pair of registration rollers 3*e*. Then, the toner image formed on the photosensitive drum 7 of the process cartridge B is transferred to the recording medium 2 by a voltage being applied to a transferring roller 4 as transferring means. Thereafter, the recording medium 2 to which the toner image has been transferred is transported to fixing means 5 by a transportation guide 3*f*. The fixing means 5 has a driving roller 5*c* and a fixing roller 5*b* containing a heater 5*a* therein. The fixing means applies heat and pressure to the passing recording medium 2 to thereby fix the transferred toner image. The recording medium 2 is then transported by pairs of delivery rollers 3*g*, 3*h* and 3*i*, and is delivered onto a delivery tray 6 through a surface reverse path 3*j*. The delivery tray 6 is provided on the upper surface of the main body 14 of the image forming apparatus A. A swingable flapper 3*k* can be operated to deliver the recording medium 2 by a pair of delivery rollers 3*m* without the intermediation of the surface reverse path 3*j*. In the present embodiment, the pickup roller 3*b*, the pairs of transporting rollers 3*c* and 3*d*, the pair of registration rollers 3*e*, the transportation guide 3*f*, the pairs of delivery rollers 3*g*, 3*h* and 3*i* and the pair of delivery rollers 3*m* together constitute transporting means 3.

On the other hand, in the process cartridge B, as shown in FIGS. 1 and 3, the photosensitive drum 7 is rotated and the surface thereof is uniformly charged by the application of a voltage to the charging roller 8 which is charging means. Then, the laser beam from the optical system 1 modulated in accordance with the image information is applied to the photosensitive drum 7 through an exposure opening portion 1*e* to thereby form a latent image. The latent image is developed by the developing means 9 by the use of a toner. That is, the charging roller 8 is provided in contact with the photosensitive drum 7, and effects charging on the photosensitive drum 7. The charging roller 8 is driven to rotate by the photosensitive drum 7. Also, the developing means 9 supplies the toner to the developing area of the photosensitive drum 7 to thereby develop the latent image formed on the photosensitive drum 7. The optical system 1 has a laser diode 1*a*, a polygon mirror 1*b*, a lens 1*c* and a reflecting mirror 1*d*.

The developing means 9 feeds the toner in a toner container 11A to a developing roller 9*c* by the rotation of a toner feeding member 9*b*. The developing roller 9*c* containing a stationary magnet therein is rotated and also a toner layer in which triboelectrification charges have been induced by a developing blade 9*d* is formed on the surface of the developing roller 9*c*, and the toner is supplied to the developing area of the photosensitive drum 7. The toner is then shifted to the photosensitive drum 7 in conformity with the latent image to thereby form a toner image and visualize the image. The developing blade 9*d* regulates the amount of toner on the peripheral surface of the developing roller 9*c* and also induces triboelectrification charges in the toner. Also, a toner agitating member 9*e* for circulating the toner in a developing chamber is rotatably mounted in the vicinity of the developing roller 9*c*.

A voltage opposite in polarity to the toner image is applied to the transferring roller 4 to thereby transfer the toner image formed on the photosensitive drum 7 to the recording medium 2, whereafter any residual toner on the photosensitive drum 7 is removed by cleaning means 10. The cleaning means 10 scrapes off the residual toner on the photosensitive drum 7 by a cleaning blade 10*a* provided in abutting relationship with the photosensitive drum 7 and collects the removed toner into a removed toner reservoir 10*b*.

Figure 4:
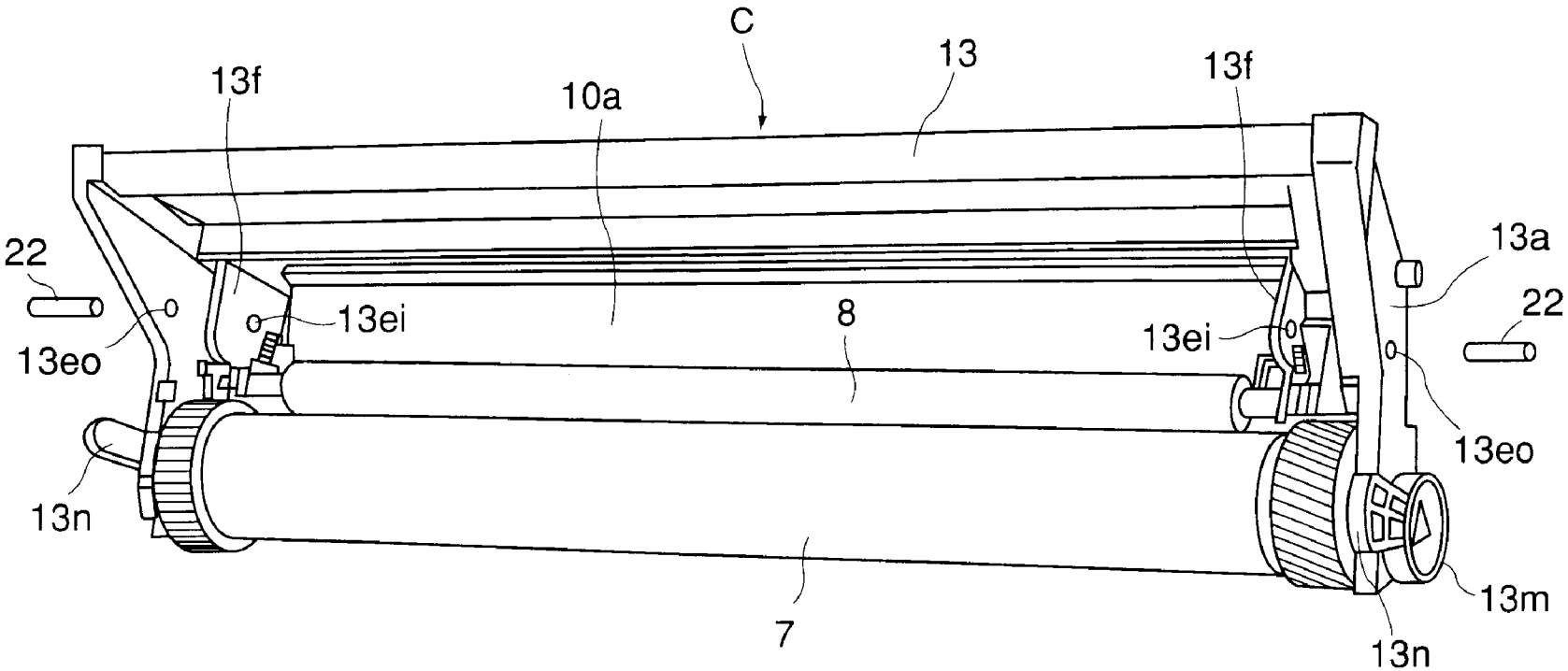
FIG. 4 is a perspective view showing a cleaning unit according to an embodiment of the present invention.

When an opening-closing member 35 provided on a right and upper portion of the main body 14 of the apparatus shown in FIG. 1 is opened around the hinge 35*a* thereof as a fulcrum, it is seen that guide rails (not shown) are provided obliquely from right and upper positions to left and lower positions on the right and left sides of the right and upper portion of the main body 14 of the apparatus. On the other hand, as shown in FIG. 4, round guides 13*m* to be fitted into positioning grooves formed at the terminal ends of the guide rails and long ridge-shaped posture-determining guides 13*n* integral with or separate from the round guides 13*m* and to be fitted into the guide rails are provided at the right and left ends on the axis of the photosensitive drum 7 of the process cartridge B, and the round guides 13*m* and the posture-determining guides 13*n* are inserted into the aforementioned guide rails to thereby mount the process cartridge B to the main body 14 of the apparatus. To detach the process cartridge B from the main body 14 of the apparatus, the process cartridge can be detached out of the main body 14 of the apparatus by pulling the process cartridge up from left direction below toward the right up direction, conversely what has been described above.

The mounting or dismounting of the process cartridge B is effected by putting a hand on the protruding threads 11*c* of the recess 17 of an upper frame 11*a* and the protruding threads 11*c* of a lower frame 11*b*. A toner frame 11 comprises the upper frame 11*a* and the lower frame 11*b* made integral with each other by being welded together on a joint surface U.

Frame Construction of the Process Cartridge

Figure 6:
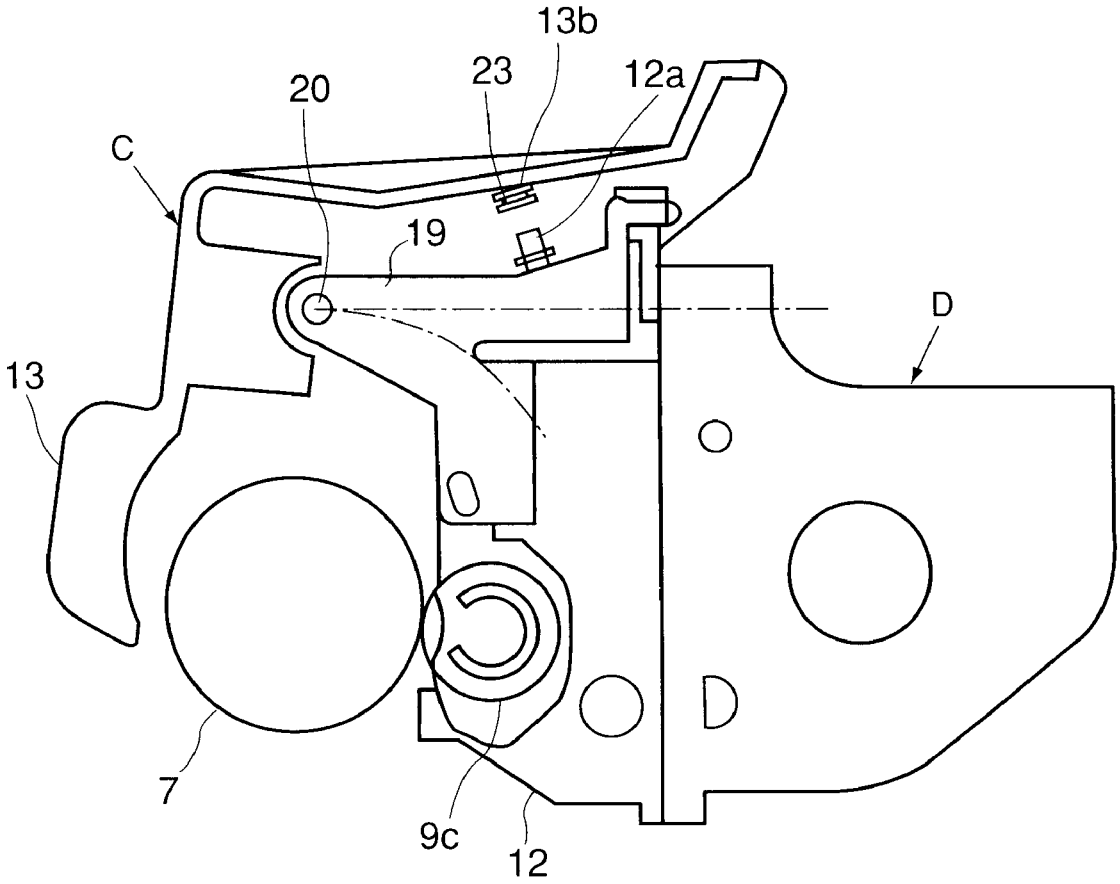
FIG. 6 is a longitudinal cross-sectional view showing the construction of the connecting portion of the frames of the process cartridge.

The process cartridge B according to the present embodiment is such that a developing unit D comprising the toner frame 11 having the toner container (toner containing portion) 11A containing the toner therein and a developing frame 12 holding the developing means 9 such as the developing roller 9*c*, the toner frame 11 and the developing frame 12 being joined together by welding at locations 701*a* and 701*b*, and a cleaning unit C comprising the cleaning means 10 such as the cleaning blade 10*a* and the charging roller 8 attached to a cleaning frame 13 are rotatably connected together with connecting pins 22 as a fulcrum. As shown in FIG. 6, a compression coil spring 23 is compressedly provided with its opposite end portions inserted in a spring receiving portion 13*b* of the cleaning frame 13 and a bar-shaped spring-retainer 12*a* of the developing frame 12, whereby the cleaning frame 13 and the developing frame 12 are biased counter-clockwisely and clockwisely, respectively, about a hole 20 to thereby bring the photosensitive drum 7 and spacer rollers 9*i* on the opposite ends of the developing roller 9*c* into pressure contact with one another.

Method of Connecting the Cleaning Frame and the Developing Frame Together

Figure 5:
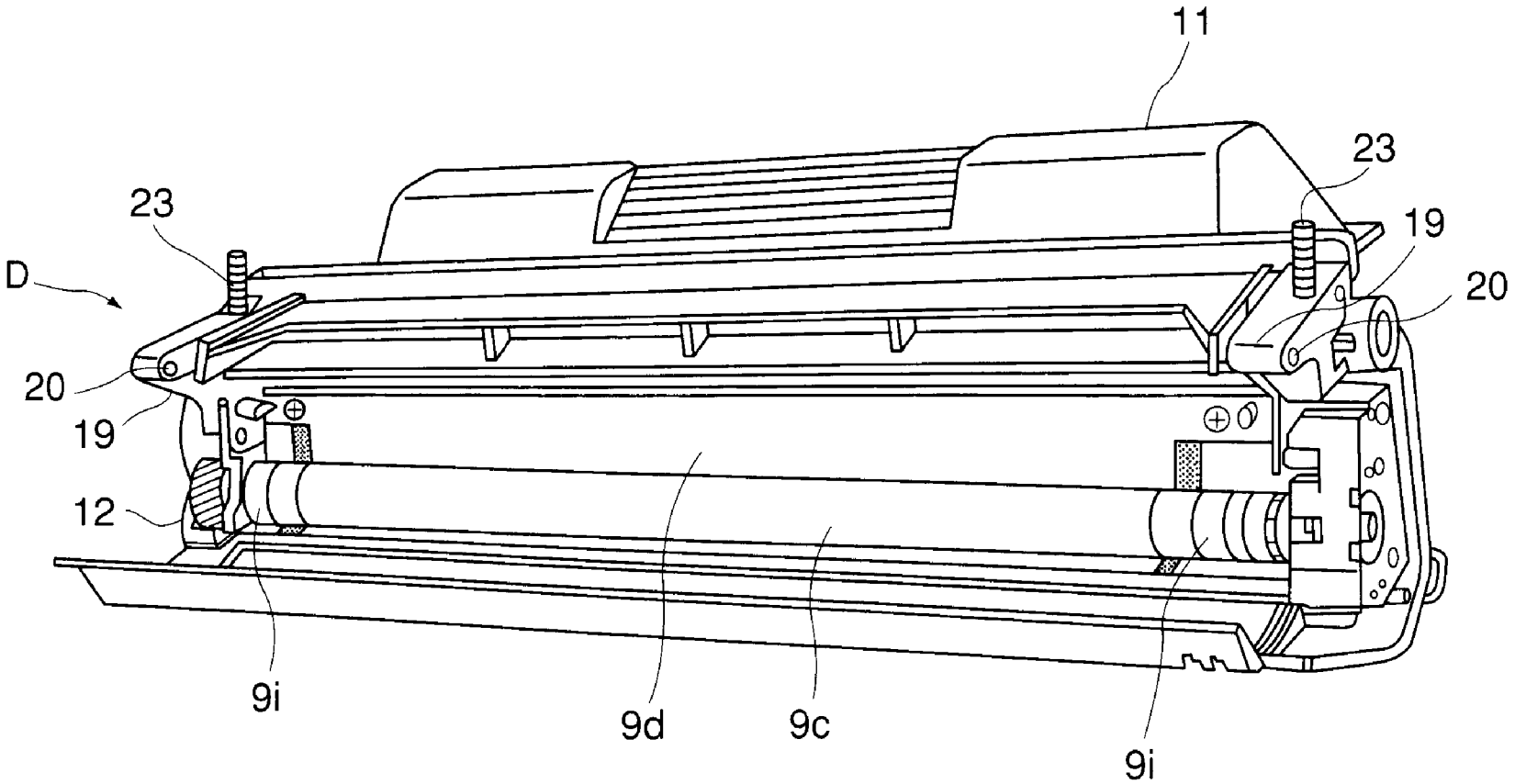
FIG. 5 is a perspective view showing a developing unit according to an embodiment of the present invention.

FIGS. 4, 5, 6 and 7 show a method of connecting the cleaning unit C and the developing unit D together. FIG. 4 shows the cleaning frame 13 which is a first frame and the connecting pins 22. As shown in FIGS. 5 and 6, arm portions 19 protrude toward the cleaning frame 13 at the lengthwise opposite ends of the developing frame 12, which is a second frame. Hanging holes 20 are formed coaxially with each other at the distal ends of the two arm portions 19 of the developing frame 12. A hole 13*eo* is formed in the lengthwise outer plate 13*a* of the cleaning frame 13, and a hole 13*ei* is formed in an inner plate 13*f* spaced apart from the outer plate 13*a* by a little greater distance than a size of the width of the arm portions 19 on the inner side of the outer plate 13*a*. The holes 13*eo* and 13*ei* are on a lengthwise straight line and are parallel to the photosensitive drum 7. The diameter of the hole 13*eo* is slightly larger than or substantially equal to the diameter of the hole 13*ei*.

To connect the cleaning frame 13 and the developing frame 12 together, the arm portions 19 of the developing frame 12 are inserted between the outer plates 13*a* and the inner plates 13*f* of the cleaning frame 13 and positioning is effected so that the supporting hole portions 13*e* (13*ei*, 13*eo*) and the hanging holes 20 of the developing frame 12 may be disposed substantially coaxially with each other, thereafter the connecting pins 22 are force-fitted from the opposite outer sides of the cleaning frame 13. The outer diameter portion of the connecting pin 22 and the inner diameter of the supporting hole 13*ei* of the cleaning frame 13 are in tight fit relationship, and the outer diameter portion of the connecting pin 22 and the inner diameter of the supporting hole 13*eo*, and the outer diameter portion of the connecting pin 22 and the hanging holes 20 of the developing frame 12 are in running fit relationship and therefore, after the connecting pins 22 are force-fitted into the supporting holes 13*ei* to thereby complete the assembly, the cleaning frame 13 is supported for rotation about the connecting pins 22, which on the other hand, are restrained relative to the cleaning frame 13 with a strength that can endure a predetermined or greater pull-out load.

Figure 7:
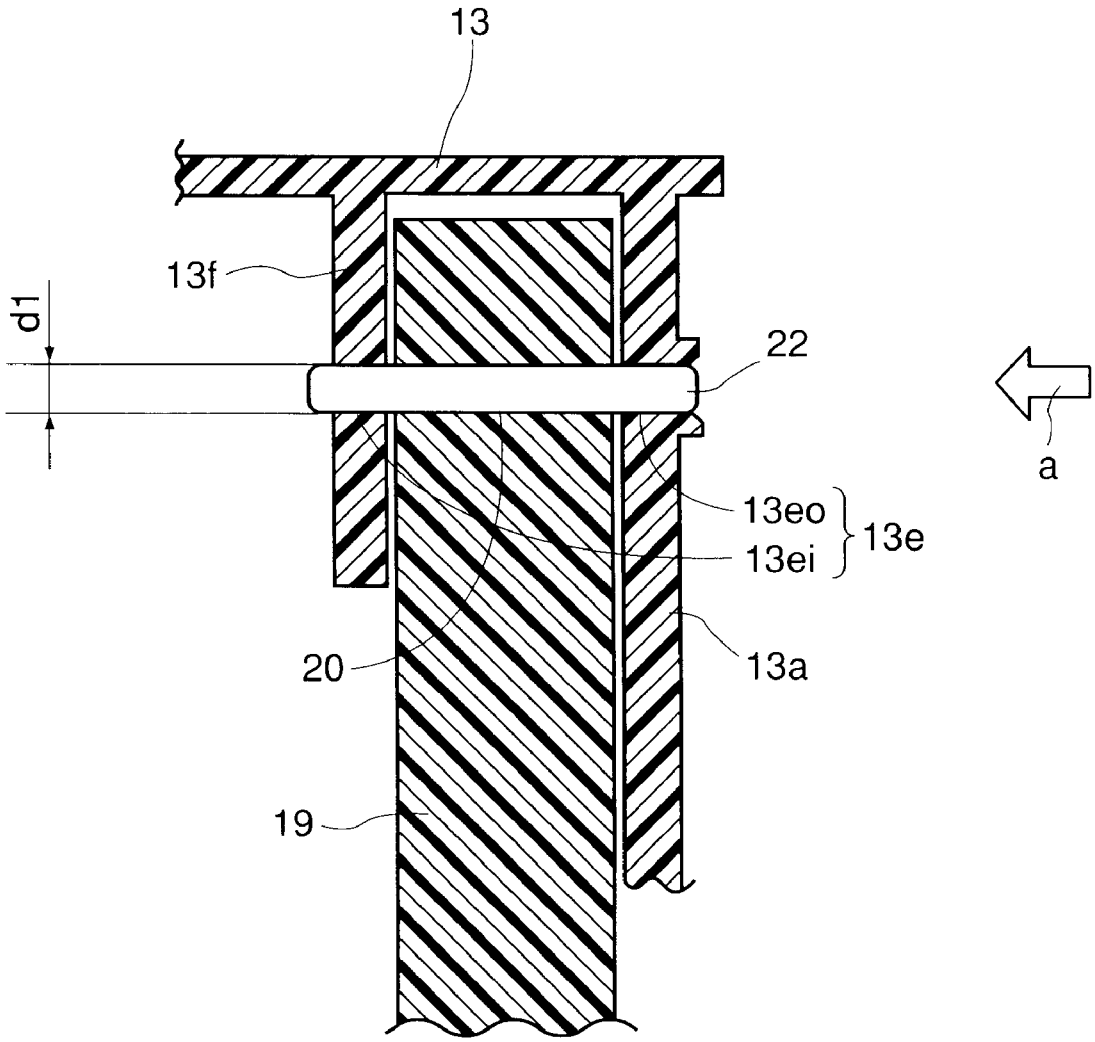
FIG. 7 is a horizontal cross-sectional view showing a frame connecting portion according to the conventional art.

FIG. 7 is a cross-sectional view showing the details of the connecting construction by a conventional connecting pin. The connecting pin 22 is a cylindrical solid pin made of steel such as stainless steel, or a nonferrous metal such as aluminum or brass, and manufactured by cutting, grinding or cold forming and has an outer diameter d1. In FIG. 7, a direction of insertion of the connecting pin 22 is indicated by the arrow "a", and the state shown in FIG. 7 is an assembly-completed state. That is, the connecting pin 22 is inserted from the outer side toward the inner side of the cleaning frame 13. In the example of the conventional art, the outer diameter d1 of the connecting pin 22 is d1=ϕ3.0 mm (tolerance: maximum 0 mm, minimum −0.020 mm), and the inner diameters of the holes 13*ei*, 13*eo* and the hanging holes 20 are ϕ3.0 mm (tolerance: maximum −0.030 mm, minimum −0.060 mm), ϕ3.05 mm (tolerance: maximum +0.050 mm, minimum 0 mm), and ϕ3.0 mm (JIS D10, tolerance: maximum +0.060 mm, minimum +0.020 mm), respectively. As the result, the connecting pin 22 is tight-fitted in the hole 13*ei* of the cleaning frame 13 and is restrained by the force-fit, the hanging hole 20 of the developing frame 12 is running-fitted relative to the connecting pin 22 and thus, the developing frame 12 is rotatably connected with the connecting pin 22 as a rotation axis.

Now, if in the conventional construction as described above, the connecting pin 22 should slip out of one of the holes 13*eo* and 13*ei* of the cleaning frame 13, the connecting pin 22 will become a cantilever and the pressure contact between the photosensitive drum 7 and the developing roller 9*c* at the opposite ends thereof will become unstable, and a desired electrostatic latent image or visible image cannot be obtained and as the result, a desired image cannot be obtained. Furthermore, if the connecting pin 22 slips out of the hanging hole 20 of the developing frame 12, the cleaning frame 13 and the developing frame 12 will separate from each other and will become incapable of performing their function as an image forming apparatus.

Accordingly, in order to avoid the inconvenience as noted above, heretofore the outer diameter of the connecting pin 22 and the inner diameter of the hole 13*ei* have been strictly controlled to thereby always secure a predetermined force-fit strength so that the force-fit of the connecting pin 22 into the hole 13*ei* of the cleaning frame 13 may not be released.

The predetermined force-fit strength referred to here is, for example, the strength to endure (i.e., not slipping out) vibration or shock applied in the physical distribution process after the process cartridge has been shipped. That is, in the physical distribution process, vibration or shock greater than during image formation or during the user's handling is applied the process cartridge and therefore, the physical distribution process is a more severe condition for the slipping-out of the connecting pin 22. Accordingly, sufficient slipping-out preventing strength is necessary to endure without slipping out the vibration or shock occurring in the physical distribution process.

The present invention has as its object to secure a sufficient slip-out preventing strength of the connecting pin 22 relative to the holes 13*eo* and 13*ei* of the cleaning frame 13 without performing the severe control as described above.

Embodiment 1

Figure 8:
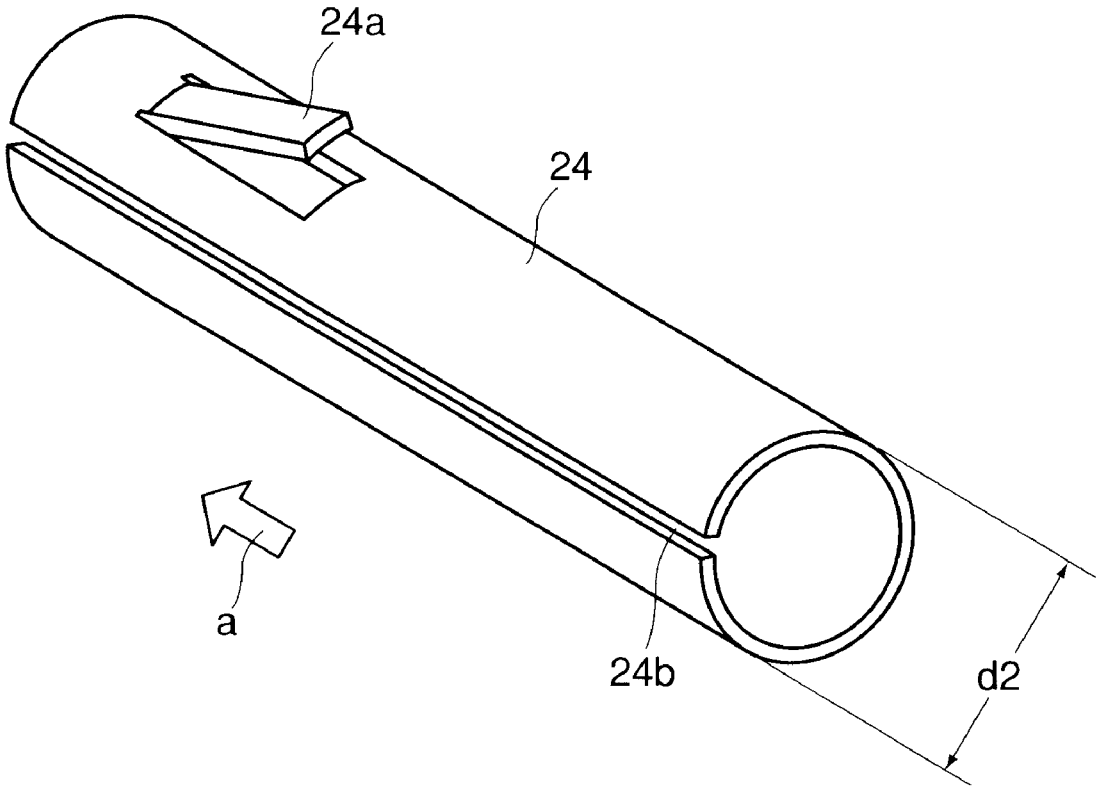
FIG. 8 is a perspective view showing a connecting pin according to Embodiment 1 of the present invention.
Figure 9:
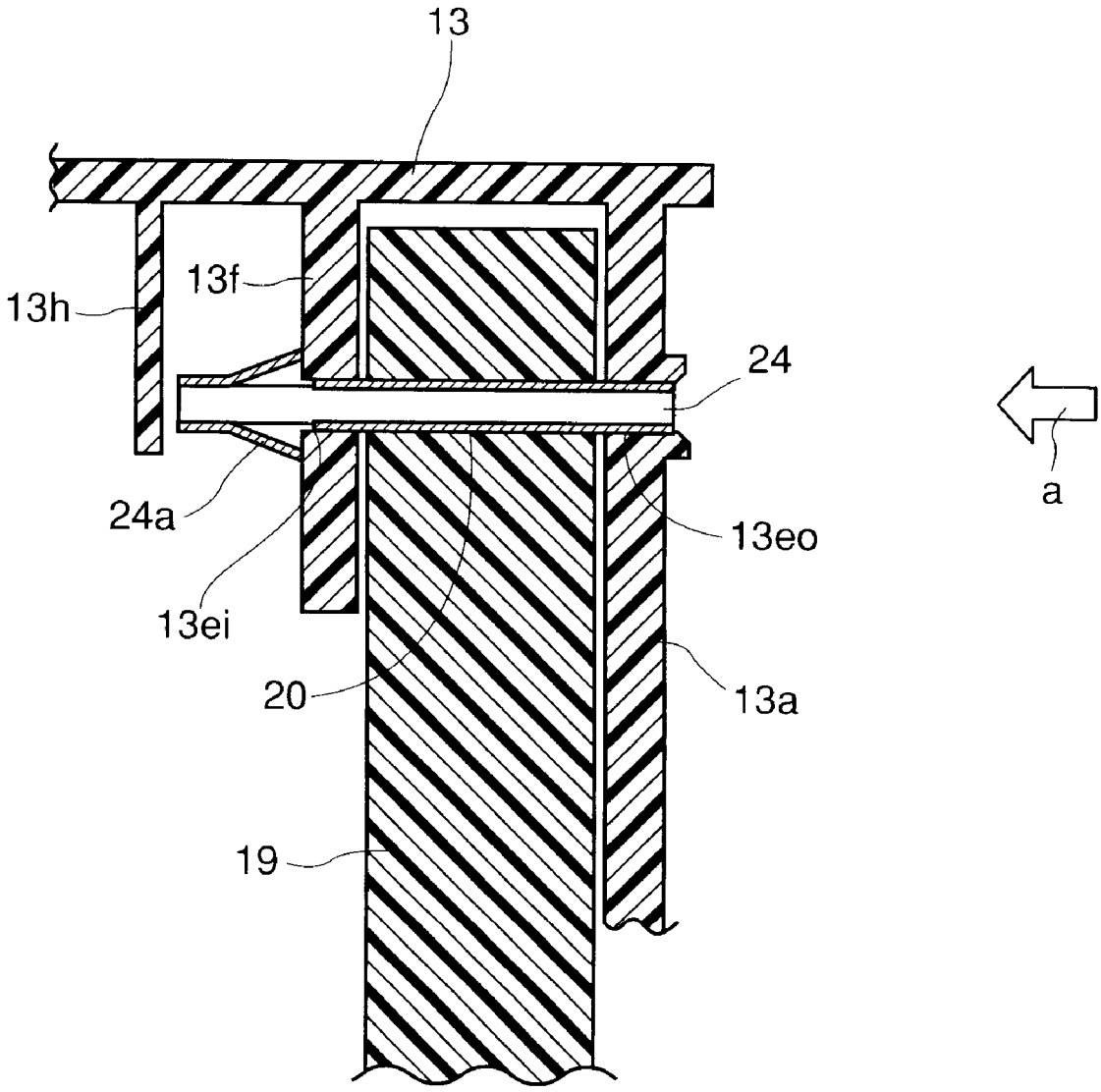
FIG. 9 is a horizontal cross-sectional view showing a frame connecting portion according to Embodiment 1 of the present invention.

In order to achieve the above object, a connecting pin 24 as shown in FIG. 8 is used as Embodiment 1 of the present invention. The connecting pin 24 shown in FIG. 8 is of a cylindrical shape (hereinafter referred to as the hollow pin) and formed with a restraining portion 24*a* by cutting, raising, and bending so that the leading end of the restraining portion 24*a* in the direction indicated by the arrow "a" which is the direction of insertion is made the bending proximal base, and the trailing end of the restraining portion 24*a* in the direction indicated by the arrow "a" juts outwardly. FIG. 9 is a cross-sectional view showing the details of a connecting construction incorporating the hollow pin 24 therein. The hollow pin 24 is made of steel such as stainless steel or a nonferrous metal such as aluminum or brass having a plate thickness of the order of 0.2 mm–0.4 mm, and the restraining portion 24*a* serves as a snap fit. That is, in FIG. 9, when the hollow pin 24 is inserted in the order of a first hole 13*eo*, a hanging hole 20 (a third hole) and a second hole 13*ei* in the direction indicated by the arrow "a", the restraining portion 24*a* is inserted from the bending proximal base side and therefore is resiliently inwardly flexed by the hole 13*eo* and inserted into the hole 13*eo*, and the flexure is released when the restraining portion 24*a* has passed through the hole 13*ei*. The restraining portion 24*a* released from flexure collides against the inner plate 13*f* of the cleaning frame 13 when the hollow pin 24 is about to slip out in the direction opposite to the direction indicated by the arrow "a", but cannot be inwardly flexed because the colliding portion is not the bending proximal base. Accordingly, the hollow pin 24 can be inserted into the holes 13*eo*, 20 and 13*ei* in the direction indicated by the arrow "a", but once the hollow pin 24 is inserted, the hollow pin 24 cannot slip out in the direction opposite to the direction indicated by the arrow "a".

However, after the hollow pin 24 has been inserted until the flexure of the restraining portion 24*a* is released, when such a force that the hollow pin 24 is further pushed in the direction indicated by the arrow "a" is applied to the hollow pin 24, the restraining portion 24*a* cannot block the further insertion of the hollow pin 24. That is, when the hollow pin 24 receives a force in a direction in which the hollow pin 24 is further pushed in the direction indicated by the arrow "a" from the state of FIG. 9, the trailing portion of the hollow pin 24 will slip off the hole 13*eo*. So, in the present invention, a rib 13*h* is provided on the cleaning frame 13. The rib 13*h* is disposed at a location against which the leading portion of the hollow pin 24 collides before the trailing portion of the hollow pin 24 slips off the hole 13*eo*, and therefore can prevent the trailing portion of the hollow pin 24 from slipping off the hole 13*eo*.

Accordingly, when such a force that the hollow pin 24 slips out in a direction opposite to the direction indicated by the arrow "a" acts due to vibration or shock applied in the physical distribution process, the restraining portion 24*a* collides against the inner plate 13*f*, and when such a force that the hollow pin 24 is pushed in the direction indicated by the arrow "a" acts, the leading portion of the hollow pin 24 collides against the rib 13*h* and therefore the hollow pin 24 can be prevented from slipping off the holes 13*ei* and 13*eo*.

While in the above-described embodiment, mention has been made of an example in which the rib 13*h* is provided on the cleaning frame 13 to prevent the trailing portion of the hollow pin 24 from slipping off the hole 13*eo* when the hollow pin 24 receives a force in such a direction that it is further pushed in the direction indicated by the arrow "a" from the state of FIG. 9, this is not restrictive, but for example, the rib may be replaced by the end surface of the cleaning blade 10*a* of the cleaning means, and in short, any means that collides against the leading portion of the hollow pin 24 will do. That is, the means for preventing the hollow pin 24 from slipping off is not restricted to the rib 13*h* integral with the cleaning frame 13 which is a first frame, the cleaning blade 10*a* or a cleaning blade supporting plate, but may be any regulating member for regulating the amount of inward insertion of the hollow pin 24.

Figure 10:
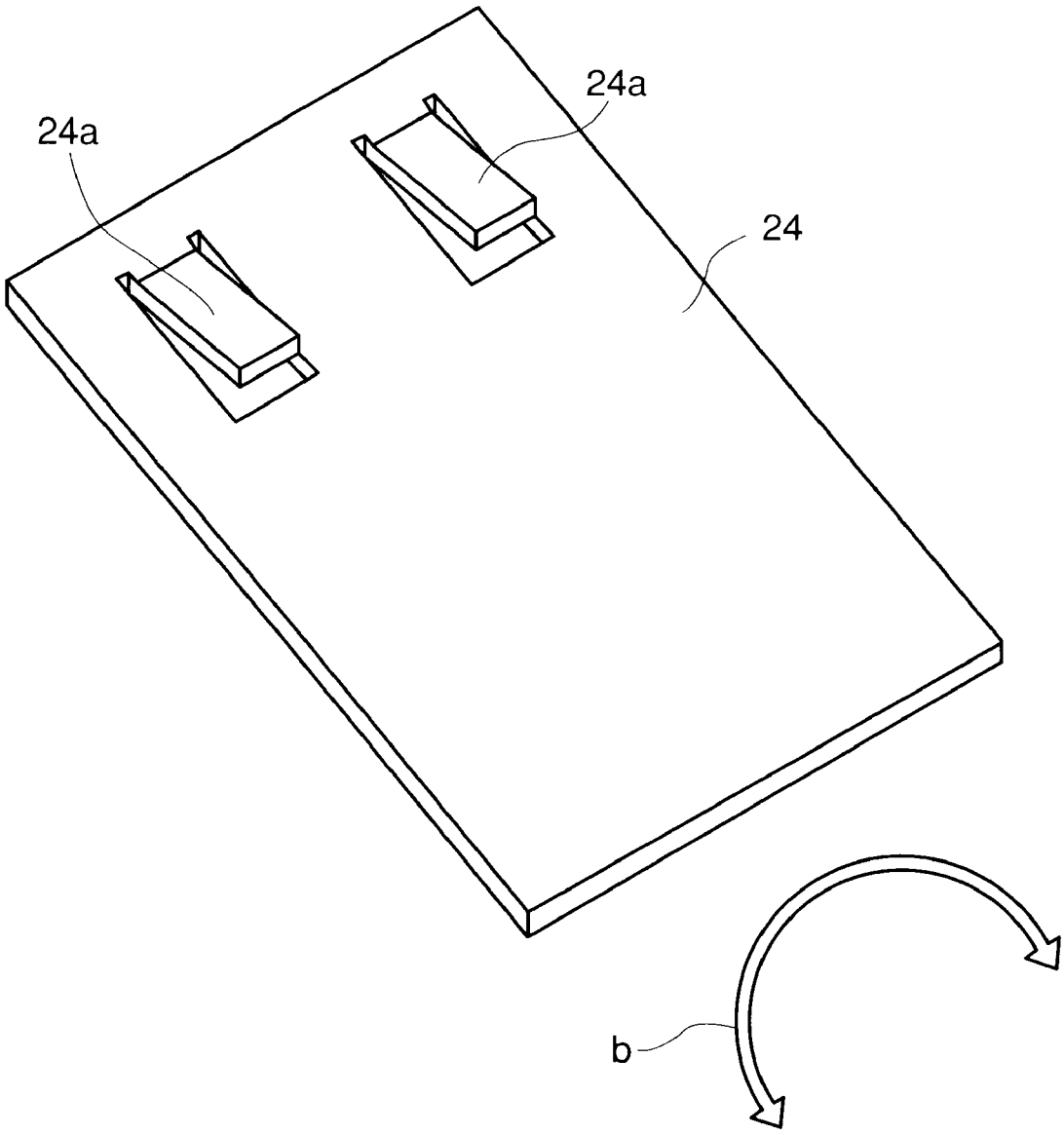
FIG. 10 is a perspective view showing the process of manufacturing the connecting pin according to Embodiment 1 of the present invention.
Figure 11:
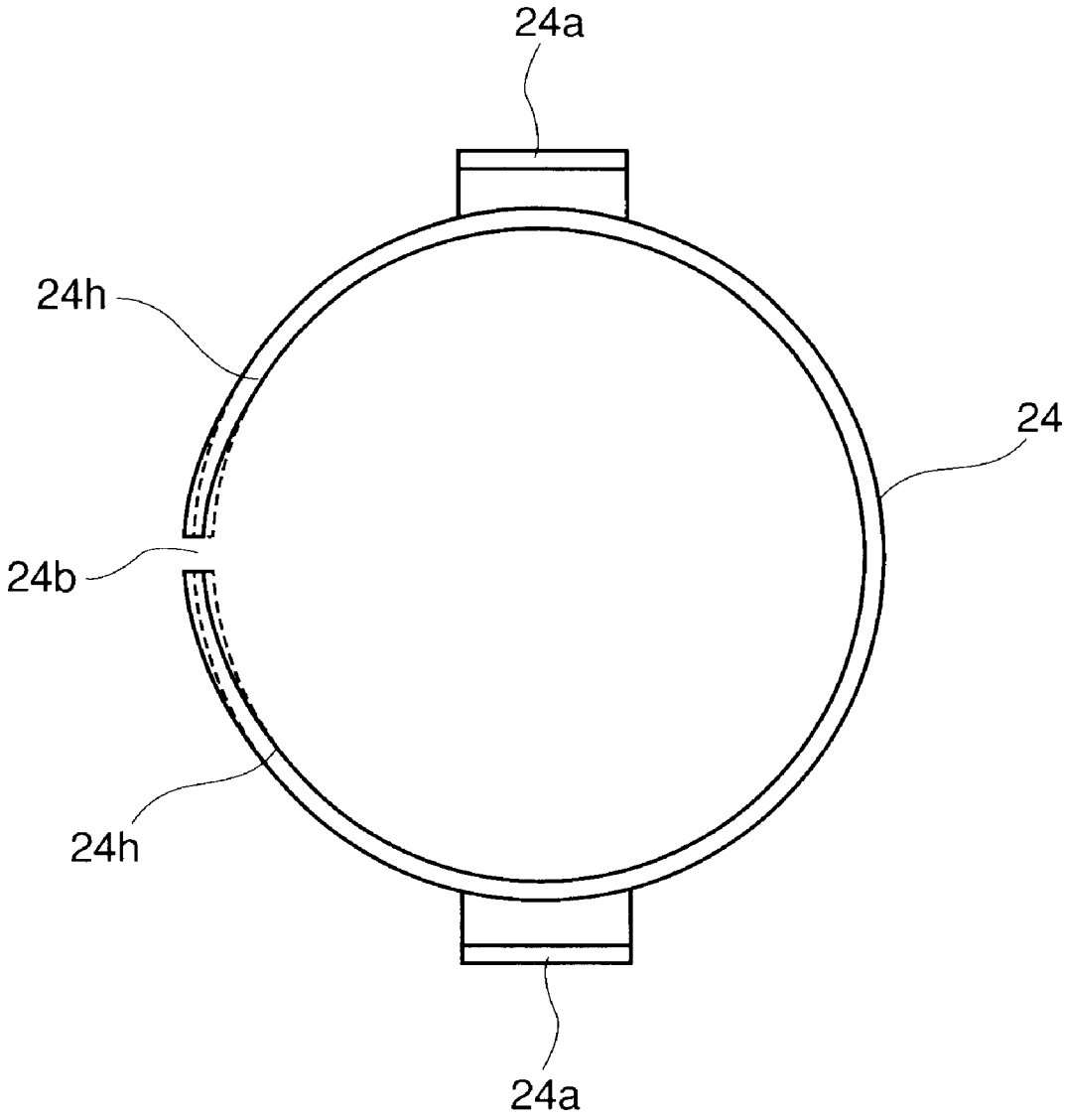
FIG. 11 is a side view showing the detailed shape of the connecting pin according to Embodiment 1 of the present invention.
Figure 12:
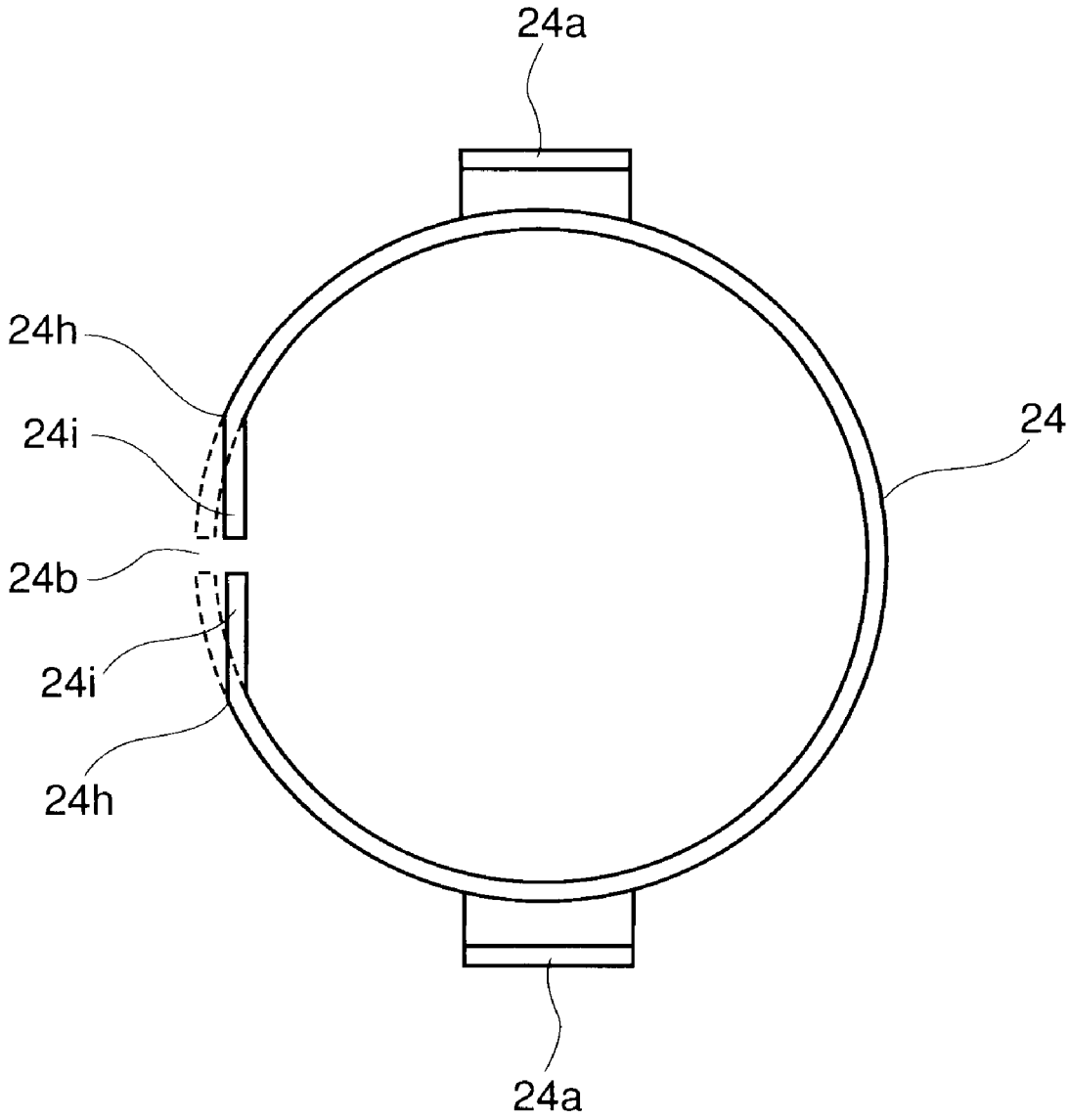
FIG. 12 is a side view showing the detailed shape of the connecting pin according to Embodiment 1 of the present invention.

The hollow pin 24 will be described in detail here. FIG. 10 shows an example of the manufacture of the hollow pin 24 shown in FIGS. 8 and 9. First, as shown in FIG. 10, a metal plate formed of steel such as stainless steel or a nonferrous metal such as aluminum or brass has its configuration blanked out into a rectangular shape by press working and portions thereof also are blanked out into a U-shape except for a proximal base of a restraining portion 24*a* to thereby form restraining portions 24*a*, and then the metal plate is bent in the direction indicated by the arrow "b" to thereby work it into a substantially cylindrical shape as shown in FIG. 11. The reason why the metal plate is made into the substantially cylindrical shape is that since there is somewhat so-called spring back with which the metal plate tends to be restored to its original shape after it has been bent, the edges of the metal plate do not come into close contact with each other, but a slit 24*b* is formed. Also, FIG. 11 is a side view of the hollow pin 24 as viewed from its trailing portion side, but since the aforementioned spring back is liable to become greater in the bent edges, the bent edges are liable to jut out as shown in FIG. 11. That is, the bent edges desired to be bent into a cylindrical shape as indicated by broken lines in FIG. 11 somewhat return outwardly as depicted by solid lines due to the spring back. When the bent edges jut out as shown in FIG. 11, there is the possibility that the corners of the edges and the inner wall of the hanging hole 20 of the developing frame 12 may be caught thereby and the hollow pin 24 and the developing frame 12 may become incapable of smoothly rotating. So, in the present invention, as shown in FIG. 12, with portions 24*h* in which the spring back substantially begins to appear as bent portions, bent edges 24*i* are designed to be bent inwardly of broken lines. If this is done, the corners of the bent edges 24*i* do not gall the inner wall of the hanging hole 20 and therefore, smooth rotation can be secured.

Figure 13:
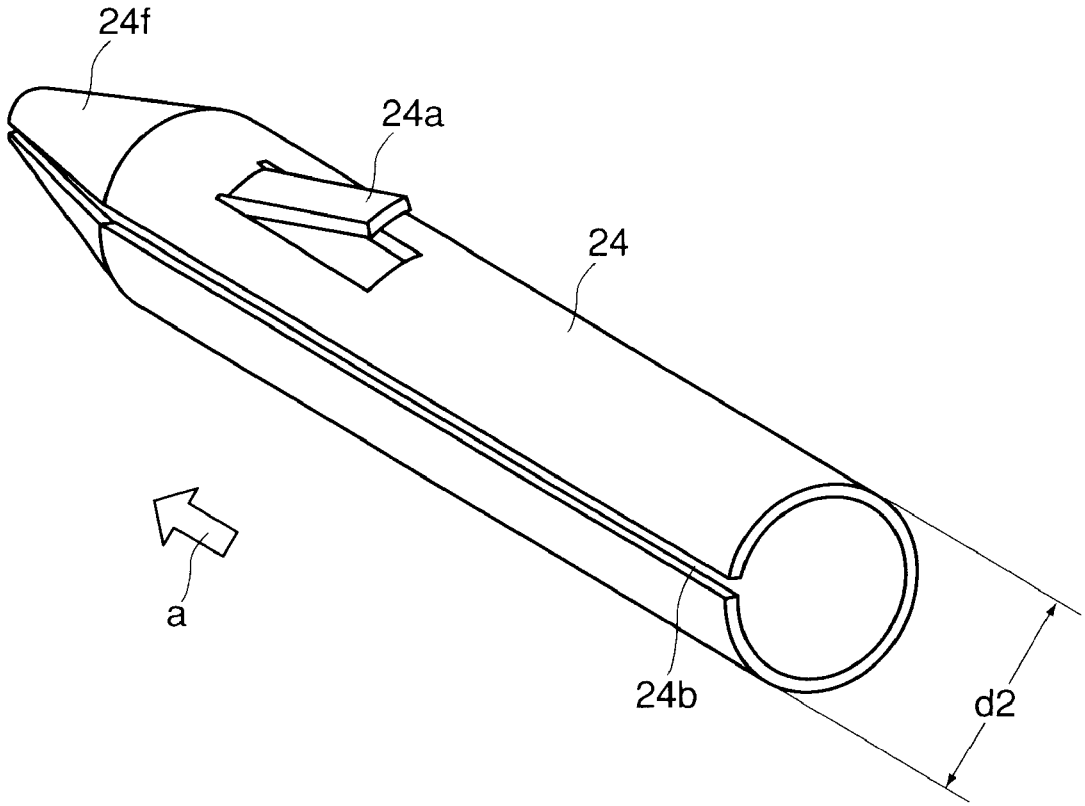
FIG. 13 is a perspective view showing another aspect of the connecting pin according to Embodiment 1 of the present invention.
Figure 14:
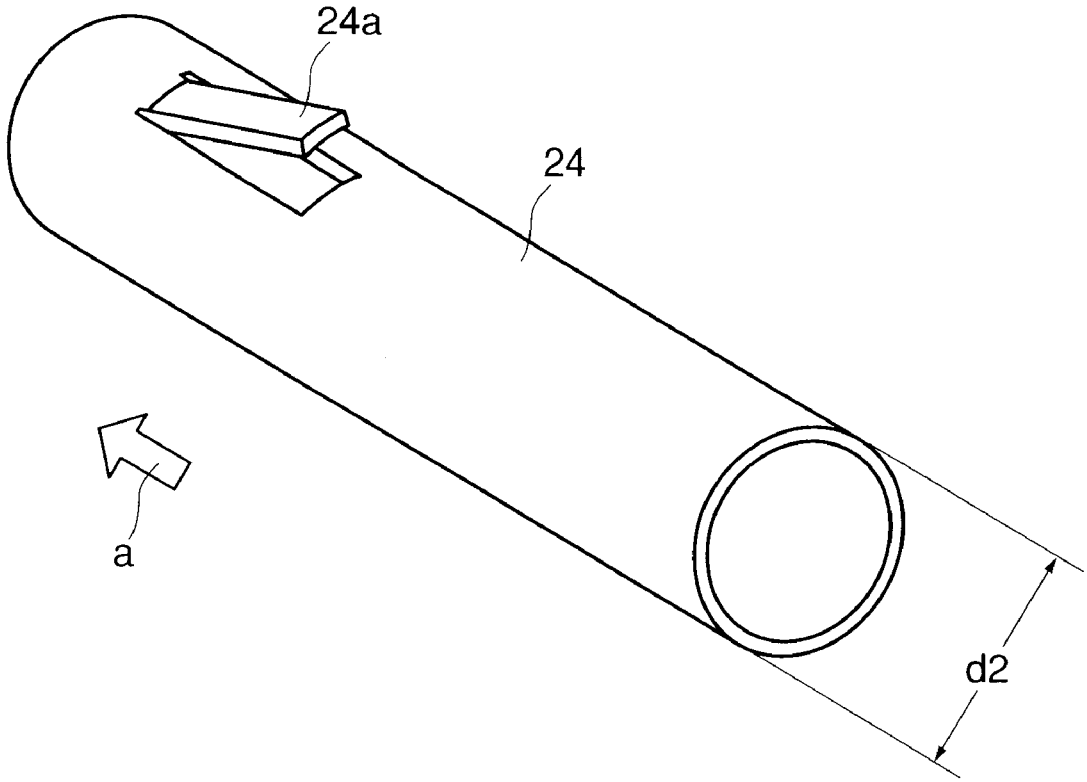
FIG. 14 is a perspective view showing another aspect of the connecting pin according to Embodiment 1 of the present invention.
Figure 17:
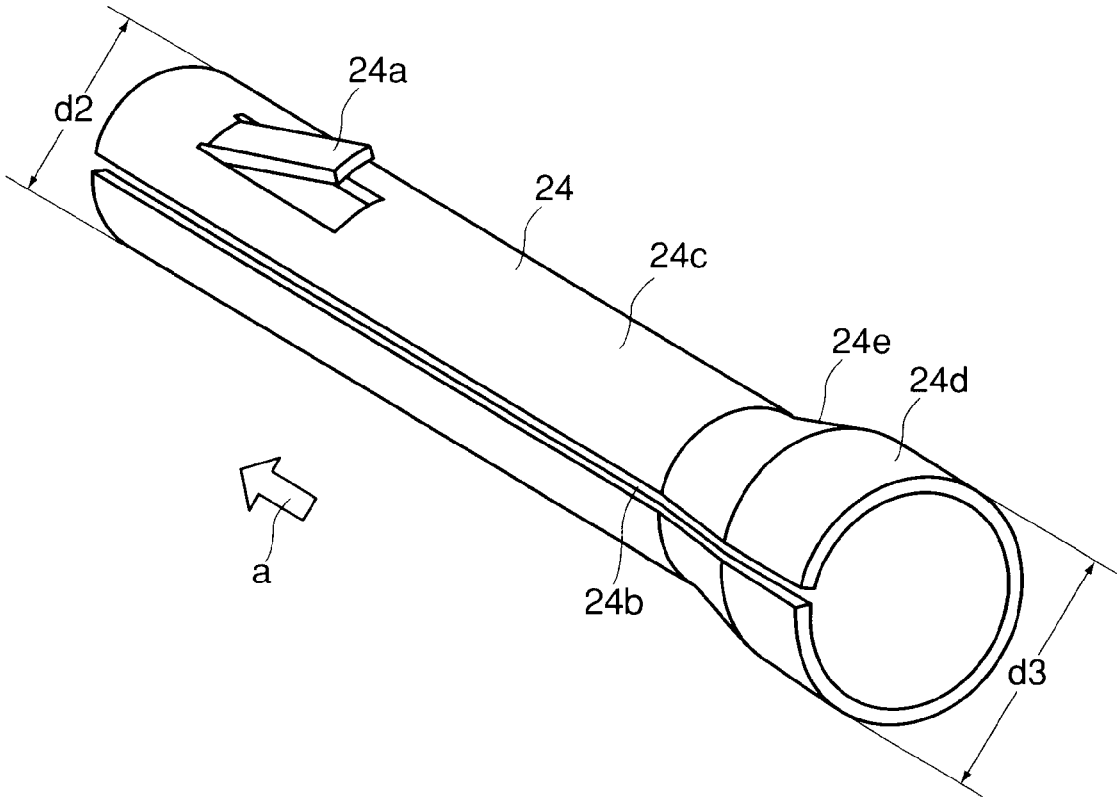
FIG. 17 is a perspective view showing a connecting pin according to Embodiment 3 of the present invention.

Letting it be said for caution's sake, if a seamless tube as shown in FIG. 14, which will be described later, is worked so as to be provided with a restraining portion 24*a*, as well as the general cylindrical shapes including Embodiment 2 and Embodiment 3, which will hereinafter be described, are defined as "a tubular shape having a circular cross-section", the hollow pin 24 having the slit 24*b* and the bent edges 24*i* further inwardly bent from the bent portions 24*h* may strictly not be said to be of a cylindrical shape, but yet may suitably be referred to as having a cylindrical shape when it is viewed, and the expression "a plate material bent into a cylindrical shape" is easy to understand in describing the aforementioned example of the pin's manufacture and therefore, herein, for the sake of convenience, the hollow pin as shown in FIGS. 8, 11, and 12, which is provided with the slit 24*b* and the inwardly bent edges 24*i*, and further, hollow pins 24 shown in FIGS. 13, 17 and 19, which will be described later, are also referred to as having a cylindrical shape.

Also, the hollow pin 24 formed with the slit 24*b* as described above has the following advantage. In the method of manufacturing the hollow pin 24 by bending a metal plate as shown in FIG. 10, there is the spring back phenomenon as previously described and therefore, the accuracy of the configurational dimension d2 of the hollow pin 24 is very difficult to provide. That is, the accuracy is difficult to provide because the amount of spring back is delicately changed by the unevenness of the plate thickness and the strength characteristic of the metal plate (the unevenness referred to herein means the unevenness within the tolerance). More particularly, it is very difficult to mass produce the pins with a stable mating-tolerance like the outer diameter d1=ϕ3.0 of the connecting pin 22 (tolerance: maximum 0, minimum −0.020), and if it is possible at all, the yield will be bad and an increase in cost will result. According to the applicant's estimate, it is presumed that when the configurational dimension d2 of the hollow pin 24 is nominally ϕ3.0 mm, the tolerance which can be stably mass produced is 0.15 mm both at maximum and minimum and the order of 0.3 mm is suitable as the tolerance range. However, if as previously described, the inner diameter of the hanging holes 20 of the developing frame 12 is ϕ3.0 mm (JIS D10 tolerance: maximum +0.060 mm, minimum +0.020 mm) and the configurational dimension d2 of the hollow pin 24 is d2=ϕ3.0±0.15 mm (tolerance: maximum +0.15 mm, minimum −0.15 mm), the hanging hole 20 and the hollow pins 24 become tight-fitted and the developing frame 12 become incapable of rotating smoothly and may prevent spacer rollers 9*i* at the opposite ends of the developing roller 9*c* from being urged against the photosensitive drum 7. So, if the configurational dimension d2 of the hollow pin 24 is ϕ3.0 (tolerance: maximum 0 mm, minimum −0.30 mm), the hanging holes 20 and the hollow pins 24 will not become tight-fitted, but yet in this case, as compared with the connecting pin 22, the play or slop of the hollow pins 24 relative to the hanging holes 20 may become great, and for the spacer rollers 9*i* at the right and left ends to be urged in a well balanced manner against the photosensitive drum 7, it is not preferable that the play or slop become great. Describing this in detail, there will be no problem if the play or slop, when the hanging holes 20 at the right and left ends and the hollow pins 24 are fitted together, is within the range of the play or slop caused by the tolerance of the connecting pin 22 and the tolerance of the hanging holes 20, but as previously described, the tolerance of the connecting pins 22 is (maximum 0 mm, minimum −0.020 mm), whereas the tolerance of the hollow pins 24 is (maximum 0 mm, minimum −0.30 mm) and therefore, the play or slop when the hanging holes 20 and the hollow pins 24 are fitted together may become great as compared with that when the connecting pins 22 and the hanging holes 20 are fitted together. Particularly, if the play or slop of one of the hanging holes 20 and one of the hollow pins 24 become a minimum within the tolerance range (when the tolerance of the inner diameter of the hanging hole 20 has become a minimum and the configurational tolerance of the hollow pin 24 has become a maximum) and the play or slop of the other hanging hole 20 and the other hollow pin 24 becomes a maximum within the tolerance range (when the tolerance of the inner diameter of the hanging hole 20 has become a maximum and the configurational tolerance of the hollow pin 24 has become a minimum), the degree of parallelism between the generatrices of the developing roller 9*c* and the photosensitive drum 7 will deviate and the pressure contact of the spacer roller 9*i* at the right and left ends with the photosensitive drum 7 will become unbalanced, and in the worse case, a desired image may become unobtainable.

However, it will be possible to elastically change the outer diameter of the hollow pin 24 if it is provided with the slit 24*b* as previously described. That is, if the hollow pin 24 is inserted into a hole having an inner diameter somewhat smaller than the outer diameter of the hollow pin 24, the hollow pin 24 will flex in a direction in which the width of the slit 24*b* becomes narrower, that is, so that the outer diameter thereof may become smaller and thus, the outer diameter will be restrained by the inner diameter of the hole. In other words, by the utilization of the springiness of the hollow pin 24, it is easily possible to match the outer diameter thereof with the inner diameter of the hole into which the pin is inserted.

Let me try to apply this way of thinking to the aforedescribed holes 13*ei*, 13*eo* and hanging hole 20. First, the inner diameter of the holes 13*ei* and 13*eo* is made equal to the outer diameter of the connecting pin 22, i.e., ϕ3.0 mm (tolerance: maximum 0 mm, minimum −0.020 mm), and the outer diameter of the hollow pins 24 is made into ϕ3.0 mm (tolerance: maximum +0.30 mm, minimum 0 mm). If this is done, from the viewpoint of tolerance, the outer diameter of the hollow pin 24 necessarily becomes equal to or larger than the inner diameter of the holes 13*ei* and 13*eo*. If substantially in this tolerance relation, the hollow pin 24 is inserted into the holes 13*ei* and 13*eo*, in almost all cases the hollow pin 24 flexes in a direction in which the width of the slit 24*b* becomes narrower, and the outer diameter thereof is restrained by the inner diameter of the holes 13*ei* and 13*eo*. Of course, there is rarely a case where the outer diameter of the hollow pin 24 and the inner diameter of the holes 13*ei* and 13*eo* become equal to each other, but it is just when both of the outer diameter of the hollow pin 24 and the inner diameter of the holes 13*ei* and 13*eo* are ϕ3.0 mm and therefore, it is within the range of the inner diameter tolerance (maximum 0 mm, minimum −0.20 mm) of both of the holes 13*ei* and 13*eo*. Accordingly, in the state in which the hollow pin 24 is inserted in the holes 13*ei* and 13*eo*, the outer diameter tolerance of the hollow pin 24 can secure the same (maximum 0 mm, minimum +0.020 mm) range as the tolerance of the holes 13*ei* and 13*eo*. Thus, even if the outer diameter of the hollow pin 24 is mass producable at ϕ3.0 mm (tolerance: maximum +0.30 mm, minimum 0 mm), if the inner diameters of the holes 13*ei* and 13*eo* are made equal to the outer diameter of the connecting pin 22, i.e., ϕ3.0 mm (tolerance: maximum 0 mm, minimum −0.020 mm), the tolerance of the hollow pin 24 in its inserted state can be made the same as that of the connecting pin 22 and therefore, the play or slop of the hollow pin 24 and the hanging hole 20 can be easily made the same as the play or slop of the connecting pin 22 and the hanging hole 20 without any increase in cost. Also, the hollow pin 24 as it is substantially inserted in the holes 13*ei* and 13*eo* flexes in the direction in which the width of the slit 24*b* becomes narrower and therefore, there can be obtained the effect that by the reaction force thereof, they are firmly connected together and are, as it were, force-fitted together and the slip-out strength thereof is increased.

If as shown in FIG. 13, a tapered leading portion 24*f* is provided at the leading portion of the hollow pin 24 by bending or drawing, it will be easy to insert the hollow pin 24 into the holes 13*ei* and 13*eo*. This is because particularly when as described above, the hollow pin 24 is to be force-fitted into the holes 13*ei* and 13*eo*, the tapered leading portion 24*f* serves as a guide and besides, the outer diameter of the hollow pin 24 gradually flexes along the taper.

Also, while in the above-described embodiment, there has been shown an example in which the hollow pin 24 is formed with the slit 24*b*, the slit 24*b* is not always necessary, but use may be made of a hollow pin having no slit as shown in FIG. 14. The hollow pin 24 shown in FIG. 14 is a so-called seamless tube worked so as to have a restraining portion 24*a*, and unlike the aforedescribed hollow pin 24 formed with the slit, it cannot be expected to have the effect of regulating its outer diameter dimension by the utilization of resiliency when it is inserted into the holes 13*ei* and 13*eo*, but yet the seamless tube has its outer diameter tolerance formed with high accuracy and therefore, it is not necessary to regulate the outer diameter dimension by the utilization of resiliency.

Also, while as an example of the manufacture of the hollow pin 24 formed with a slit, there has been shown an example in which the metal plate as shown in FIG. 10 is bent in the direction indicated by the arrow "b" and made into a substantially cylindrical shape, such a manufacturing method is not always restrictive, and for example, the hollow pin may be manufactured by applying the working of forming a slit in the seamless tube shown in FIG. 14.

Embodiment 2

Figure 15:
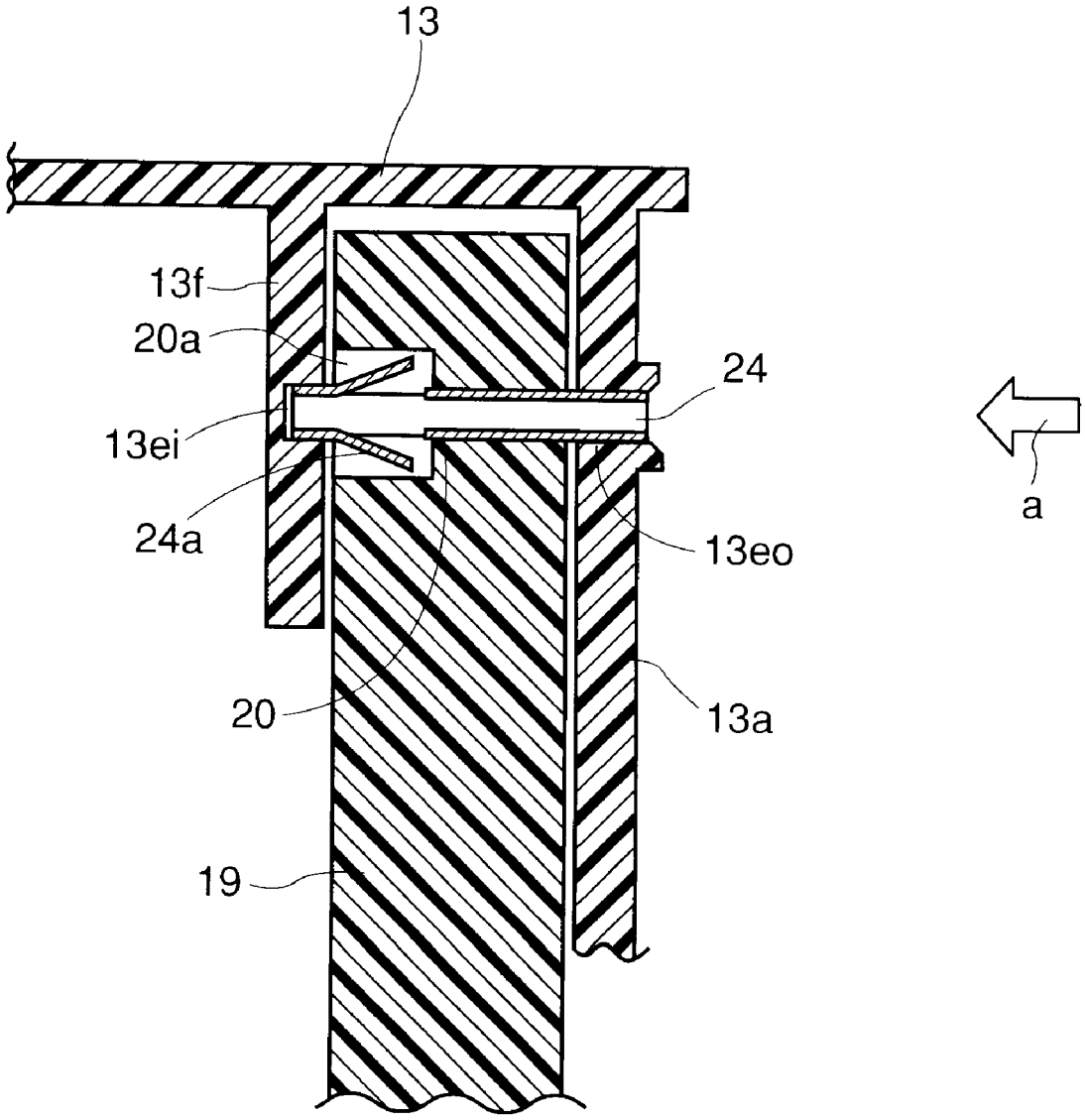
FIG. 15 is a horizontal cross-sectional view showing a frame connecting portion according to Embodiment 2 of the present invention.

A description will now be provided of Embodiment 2 shown in FIG. 15. The difference between Embodiment 2 of FIG. 15 and Embodiment 1 shown in FIG. 9 is that instead of the rib 13*h* provided on the cleaning frame 13 for preventing the trailing portion of the hollow pin 24 from slipping off the first hole 13*eo*, the second hole 13*ei* in the inner plate 13*f* is made into not a through-hole but a blind hole having its inner end closed to thereby prevent the trailing portion of the hollow pin 24 from slipping off the hole 13*eo*.

Figure 16:
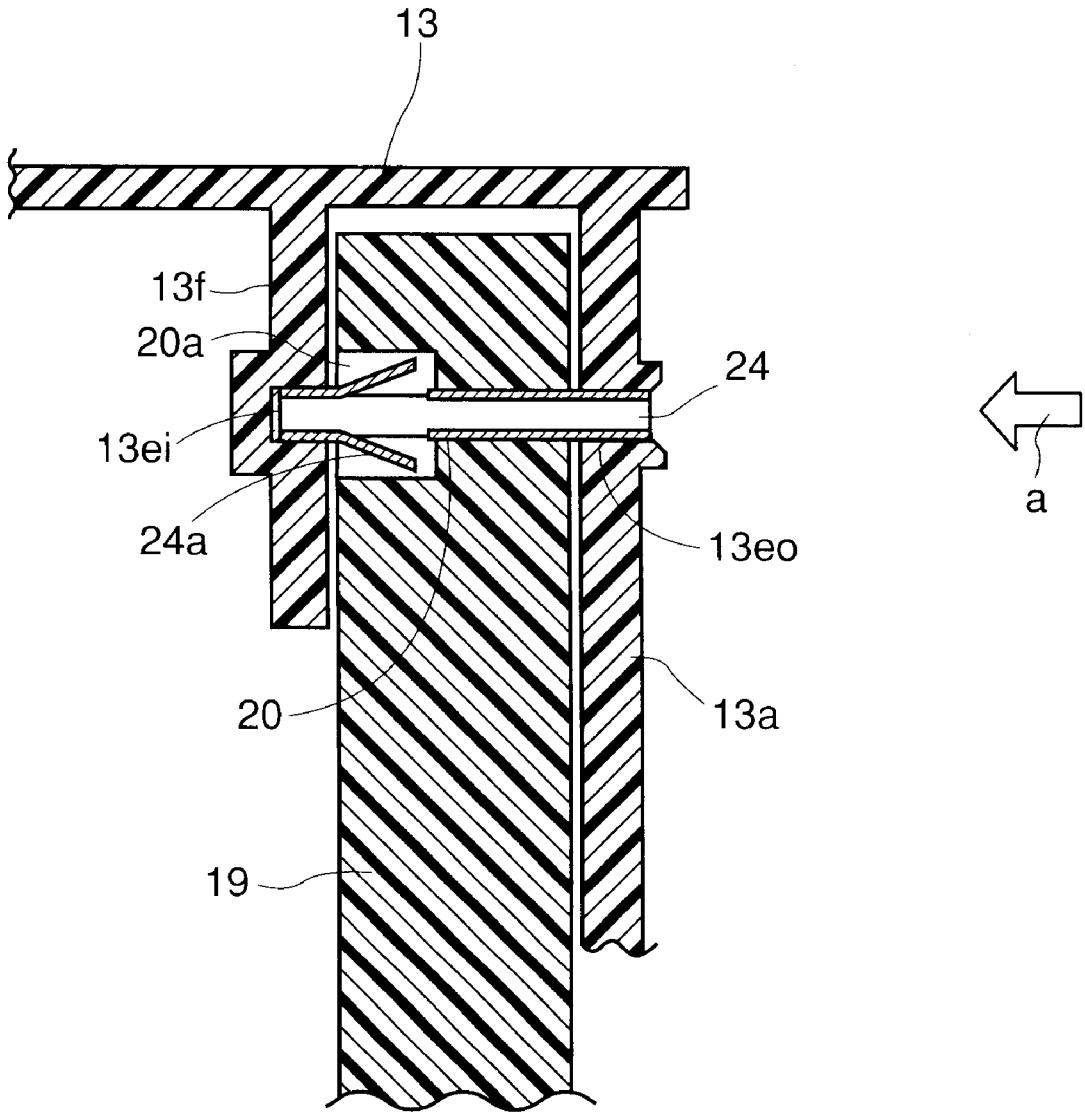
FIG. 16 is a horizontal cross-sectional view showing another aspect of the frame connecting portion according to Embodiment 2 of the present invention.

In FIG. 15, the outer diameter dimension of the hollow pin 24 and the inner diameter dimensions of the second hole 13*ei*, the first hole 13*eo* and the hanging hole 20 are the same as the dimensional relation shown in Embodiment 1, and the hole 13*ei* in the inner plate 13*f* is not a through-hole but a hole having closed its end opposite to the end through which the hollow pin 24 is inserted. A counterbore portion 20*a*, having an inner diameter larger than the dimension of the restraining portion when the flexure of the restraining portion 24*a* of the hollow pin 24 is released, is provided around the hanging hole 20 formed in the arm portion 19 of the developing frame 12, so as to surround the restraining portion 24*a*. In other words, the restraining portion 24*a* is located in an area surrounded by the inner plate 13*f* and the counterbore portion 20*a*. By doing this, even if a force acts that would cause the hollow pin 24 to slip out in a direction opposite to the direction indicated by the arrow "a", the restraining portion 24*a* collides against the seat surface of the counterbore portion 20*a*, and even if a force acts that would cause the hollow pin 24 to be pushed in the direction indicated by the arrow "a", the hollow pin 24 can be prevented from slipping off because the hole 13*ei* is closed. As a method of closing the hole 13*ei*, the inner side of the inner plate 13*f* may be made into a convex shape as shown in FIG. 16. If this is done, the fit length of the hollow pin 24 and the hole 13*ei*, like that in FIG. 9, can be secured by an amount corresponding to the thickness of the inner plate 13*f*. The counterbore portion 20*a* is not restricted to the inner plate 13*f* side of the arm portion 19 as shown in FIGS. 15 and 16, but may be provided on the outer plate 13*a* side (not shown). As a matter of course, in this case, the restraining portion 24*a* is located in an area surrounded by the outer plate 13*a* and the counterbore portion 20*a*, and when a force acts that would cause the hollow pin 24 to slip out in the direction opposite to the direction indicated by the arrow "a" acts, the restraining portion 24*a* collides against the inner side of the outer plate 13*a*. Also, it is unnecessary that the hole 13*ei* have completely closed its end opposite to the end through which the hollow pin 24 is inserted, as shown in FIGS. 15 and 16, and that end may have an aperture smaller than the outer diameter of the hollow pin 24. For example, the hole 13*ei* may be a stepped hole having an aperture on the outer end surface side of the inner plate 13*f* and an inner aperture having an inner diameter smaller than the inner diameter of the outer aperture. In short, it will suffice if the leading portion of the hollow pin 24 does not go out of the hole 13*ei*. However, if the leading portion of the hollow pin 24 has the tapered leading portion 24*f* as shown in FIG. 13, a tip end of the tapered leading portion 24*f* may be shot out of the hole 13*ei*.

Embodiment 3

Figure 18:
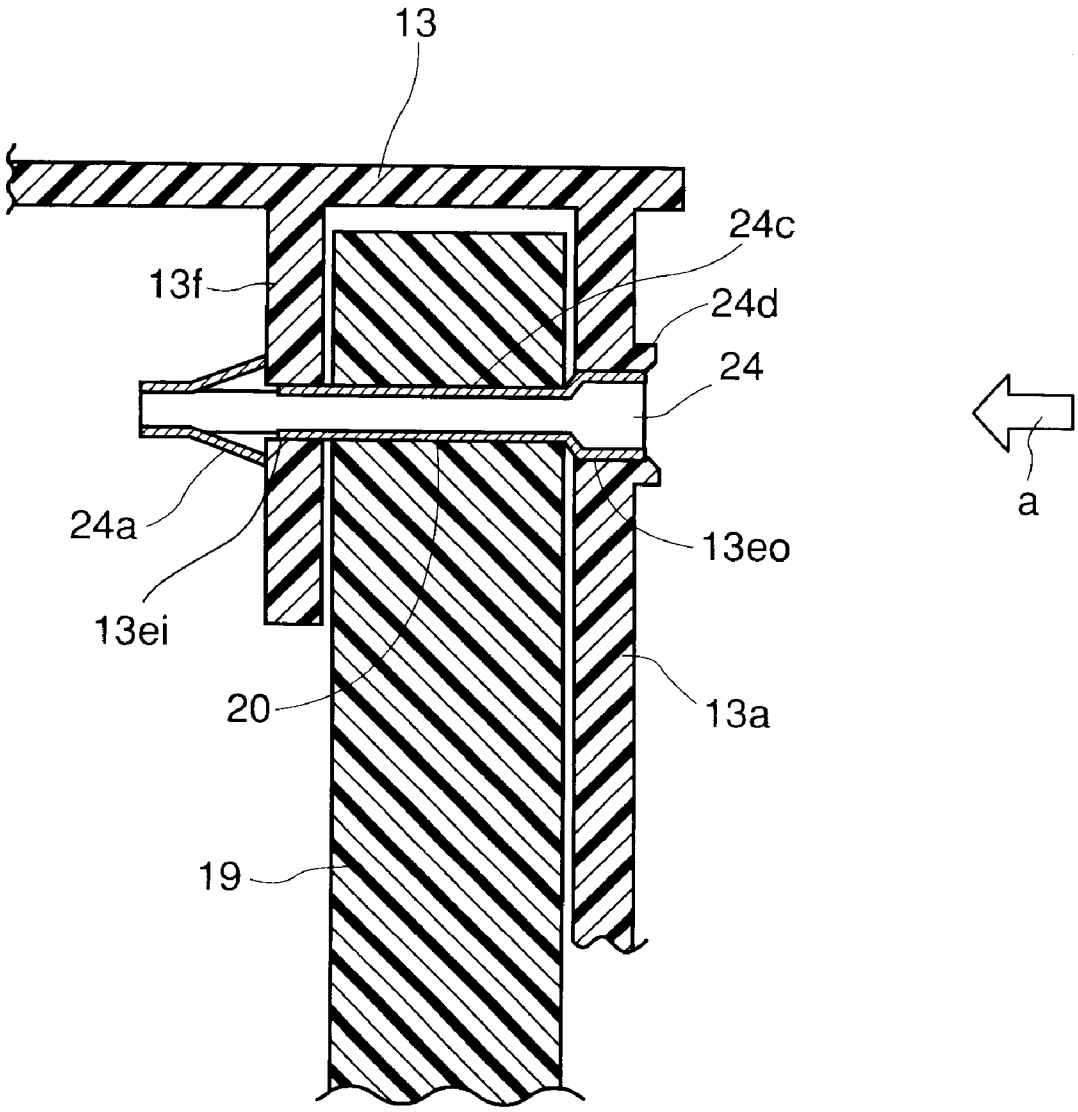
FIG. 18 is a horizontal cross-sectional view showing a frame connecting portion according to Embodiment 3 of the present invention.

A hollow pin shown in FIG. 17 will now be described. The hollow pin 24 shown in FIG. 17 comprises a small-diametered portion 24*c* having the same outer diameter as the outer diameter d2 of the hollow pin 24 shown in FIGS. 8 and 14, a large-diametered portion 24*d* having an outer diameter d3 larger than that of the small-diametered portion 24*c* formed by drawing or the like, and a tapered portion 24*e* connecting the small-diametered portion 24*c* and the large-diametered portion 24*d* together. FIG. 18 shows a state in which this hollow pin 24 is incorporated. In FIG. 18, the inner diameters of the hole 13*ei* and the hanging hole 20 and the outer diameter of the small-diametered portion 24*c* are equal to those in Embodiment 1, that is, ϕ3.0 mm (tolerance: maximum 0 mm, minimum −0.020 mm), ϕ3.0 mm (JIS D10 tolerance: maximum +0.060 mm, minimum +0.020 mm) and ϕ3.0 mm (tolerance: maximum +0.30 mm, minimum 0 mm), respectively. The inner diameter of the hole 13*eo* and the outer diameter of the large-diametered portion 24*d* are ϕ3.5 mm (tolerance: maximum 0 mm, minimum −0.020 mm) and ϕ3.5 mm (tolerance: maximum +0.30 mm, minimum 0 mm), respectively. As is apparent from FIG. 17, in this embodiment, the outer diameter of the trailing portion of the hollow pin 24 is made larger than the inner diameter of the hanging hole 20 in order to prevent the trailing portion of the hollow pin 24 from slipping off the hole 13*eo*. That is, even if a force acts that would cause the hollow pin 24 to be pushed in the direction indicated by the arrow "a" from the state of FIG. 18 , the tapered portion 24*e* strikes against the end portion of the hanging hole 20 and the hollow pin 24 is not pushed in. When a force acts that would cause the hollow pin 24 slip out in the direction opposite to the direction indicated by the arrow "a", the restraining portion 24*a* collides against the inner plate 13*f* as in Embodiment 1. Such a hollow pin having a large-diametered portion and a small-diametered portion can be introduced as a substitute for a connecting pin having a plurality of outer diameters described in Japanese Patent Application Laid-Open No. 11-15354 without the design of the cleaning frame 13 and the developing frame 12 being changed.

While in FIG. 18, a description has been provided of a case where the small-diametered portion 24*c* is fitted into the hole 13*ei* and the hanging hole 20 and the large-diametered portion 24*d* is fitted into the hole 13*eo*, the large diametered portion 24*d* may be long enough to be fitted into the hanging hole 20, and the small-diametered portion 24*c* may be fitted into the hole 13*ei* and the large-diametered portion 24*d* may be fitted into the hanging hole 20 and the hole 13*eo*. In this case, the inner diameter of the hanging hole 20 may suitably be ϕ3.5 mm (JIS D10 tolerance: maximum +0.078 mm, minimum +0.030 mm).

Figure 19:
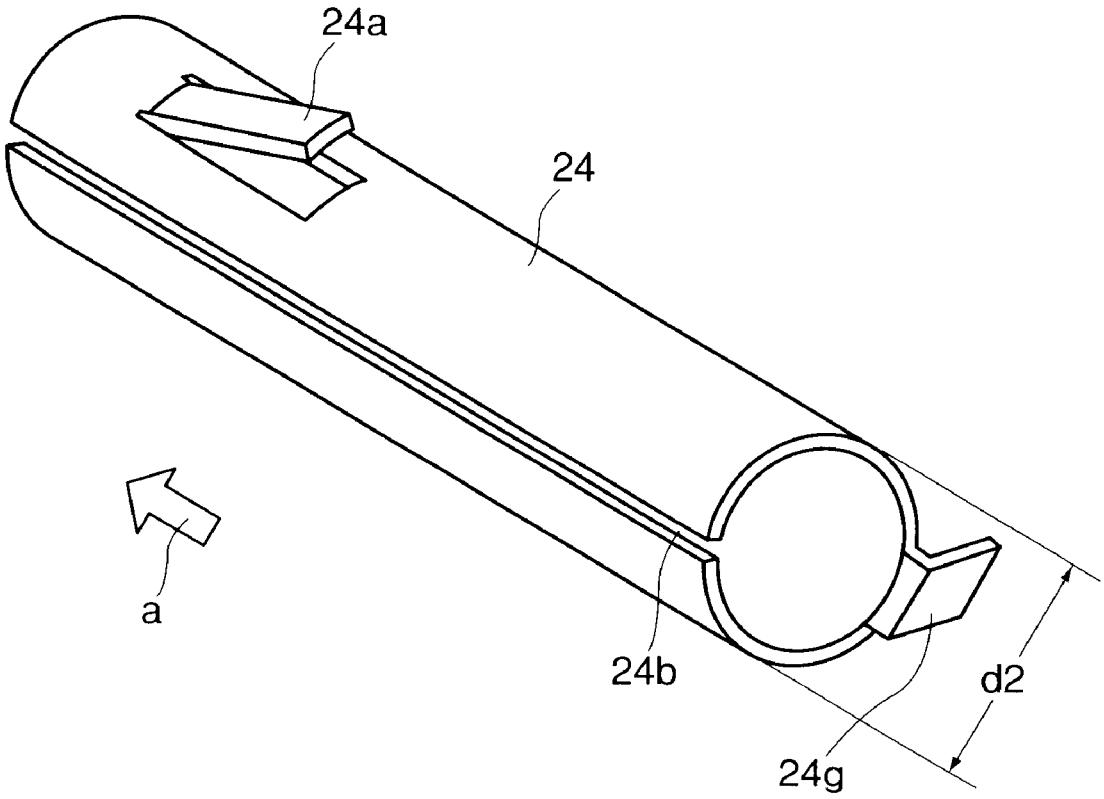
FIG. 19 is a perspective view showing another aspect of the connecting pin according to Embodiment 3 of the present invention.

Also, FIG. 19 shows a hollow pin 24 provided with a bent portion 24*g* in the trailing portion thereof, instead of the large-diametered portion 24*d*. The bent portion 24*g* is bent radially outwardly of the hollow pin 24. The bent portion 24*g* is bent perpendicularly or substantially perpendicularly to the direction of insertion of the hollow pin 24 into the holes 13*eo*, 13*ei* and the hanging hole 20. This is for preventing the trailing portion of the hollow pin 24 from slipping off the hole 13*eo* by the bent portion 24*g* striking against the outer plate 13*a* of the cleaning frame 13. If such a bent portion 24*g* is provided, it is not necessary to provide the rib 13*h* of FIG. 9, or to make the hole 13*ei* into a blind hole as shown in FIG. 15, or to make the inner diameters of the hole 13*eo* and the hole 13*ei* different from each other as shown in FIG. 18 and therefore, it is possible to introduce the hollow pin into an existing product using the conventional art shown in FIG. 7 without changing the design of the cleaning frame 13 and the developing frame 12.

While in the above-described embodiments, the shapes of the hollow pin have been shown by way of example in FIGS. 8, 13, 14, 17 and 19, the present invention is not restricted to those shapes. That is, for example, the purpose of the tapered leading portion 24*f* shown in FIG. 13 is to facilitate the insertion of the hollow pin and therefore, the leading portion of each of the hollow pins of FIGS. 14, 17 and 19 may be tapered, and each of the hollow pins of FIGS. 13, 17 and 19 may be manufactured by working the seamless tube as shown in FIG. 14. Also, while the number of the restraining portions 24*a* has been shown as two, it may be one or three or more. Also, the plate thickness, outer diameter dimension and tolerance of the hollow pin, the inner diameter dimensions and tolerances of the holes 13*ei* and 13*eo* of the cleaning frame 13, and the inner diameter dimension and tolerance of the hanging hole 20 of the developing frame 12 are not restricted to the numerical values in the above-described embodiments. In addition, the shape of the hollow pin need not always be a cylindrical shape, but may be a polygon having a triangular or square cross-section, or a semicircular shape.

According to the aforedescribed embodiments, as functional advantages, there could be realized an improvement in pull-out yield strength, and particularly an improvement in strength to endure (i.e., not slipping out) vibration or shock applied in the physical distribution process. Also, as advantages in terms of quality control, the periodic sampling inspection of the surface roughness of the connecting pin and the force-fit strength thereof to the first frame, and stringent control necessary so that a predetermined force-fit strength may be secured are not necessary.

As described above, according to the present invention, reliable connection can be ensured.

While the invention has been described with reference to the structure disclosed herein, it is not confirmed to the details set forth and this application is intended to cover such modifications or changes as may come within the purposes of the improvements or the scope of the following claims.

What is claimed is:

1. A connecting pin for a process cartridge, wherein the process cartridge is detachably mountable to a main body of an image forming apparatus and comprises a first frame configured and positioned to support an electrophotographic photosensitive drum and a second frame supporting developing means for developing an electrostatic latent image formed on the electrophotographic photosensitive drum, the first frame and the second frame being pivotally connected with each other, and wherein said connecting pin comprises a metal plate made into a hollow shape, and is provided with a slit defined by opposed edges of said metal plate, and has formed on a portion thereof a restraining portion having its trailing end jutting out with its leading end as a bending proximal base in an inserting direction.

2. A connecting pin according to claim 1, wherein said connecting pin has a cylindrical shape.

3. A connecting pin according to claim 2, wherein said connecting pin has a small-diametered portion at a leading portion thereof in the inserting direction, and a large-diametered portion having an outer diameter larger than that of said small-diametered portion at a trailing portion thereof.

4. A connecting pin according to any one of claims 1, 2, and 3, wherein said connecting pin is formed by bending the metal plate into a cylindrical shape, and wherein opposed edges of the metal plate in a bending direction are further bent radially and inwardly thereof.

5. A connecting pin according to any one of claims 1, 2, and 3, wherein a leading portion of said connecting pin in the inserting direction is tapered.

6. A connecting pin according to claim 5, wherein said leading portion is tapered by drawing or bending.

7. A connecting pin according to any one of claims 1, 2, and 3, wherein a bent portion perpendicular or substantially perpendicular to the inserting direction and jutting outwardly of said connecting pin is formed on a trailing portion of said connecting pin in the inserting direction.

8. A process cartridge detachably mountable to a main body of an electrophotographic image forming apparatus, said process cartridge comprising:

an electrophotographic photosensitive drum;

developing means for developing an electrostatic latent image formed on said electrophotographic photosensitive drum;

a first frame supporting said electrophotographic photosensitive drum and having an outer plate and an inner plate on each of the opposite sides thereof in a lengthwise direction which is an axial direction of said electrophotographic photosensitive drum, said outer plate facing the outside, said inner plate being disposed inwardly of said outer plate in the lengthwise direction, said outer plate and said inner plate having a first hole and a second hole, respectively, on an axis parallel to said electrophotographic photosensitive drum;

a second frame positioned between said outer plate and said inner plate of said first frame and having a third hole which can be aligned with said first and second holes, said second frame supporting said developing means; and a connecting pin comprising a metal plate made into a hollow shape, and being provided with a slit defined by opposed edges of said metal plate, and having formed on a portion thereof a restraining portion having its trailing end jutting out with its leading end as a bending proximal base in an inserting direction, wherein said connecting pin is fitted into said first hole and said second hole with its opposite ends supported by said first frame within said first and second holes, and rotatably fitted into said third hole.

9. A process cartridge according to claim 8, wherein said restraining portion is located on an inside side of said inner plate in the lengthwise direction.

10. A process cartridge according to claim 8 or 9, wherein a regulating member for regulating an amount of inward insertion of said connecting pin is provided on an inside side of said inner plate in the lengthwise direction.

11. A process cartridge according to claim 10, wherein said regulating member is a rib formed integrally with said first frame.

12. A process cartridge according to claim 10, wherein said regulating member is attached to said first frame, and serves also as cleaning means for removing developer residual on said electrophotographic photosensitive drum.

13. A process cartridge according to claim 8, wherein said second hole is closed on an inside side in the lengthwise direction or is a stepped hole having an outer hole on an outside side and an inner hole having an inner diameter smaller than the inner diameter of the outer hole, wherein a counterbore portion larger than an inner diameter of said third hole is provided around at least one end surface of said third hole, and wherein said restraining portion is located in an area surrounded by said inner plate and said counterbore portion or an area surrounded by said outer plate and said counterbore portion.

14. A process cartridge according to claim 8 or 9, wherein said connecting pin has a small-diametered portion in a leading portion thereof in the inserting direction and has a large-diametered portion in a trailing portion thereof, said large-diametered portion has an outer diameter larger than that of said small-diametered portion, and wherein said small-diametered portion is fitted in said second hole and said third hole and said large-diametered portion is fitted in said first hole, or said small-diametered portion is fitted in said second hole and said large-diametered portion is fitted in said third hole and said first hole.

15. A process cartridge according to claim 8 or 9, wherein said connecting pin has formed on a trailing portion thereof in the inserting direction a bent portion perpendicular or substantially perpendicular to the inserting direction and jutting outwardly of said connecting pin.

16. A process cartridge according to any one of claims 8, 9, and 13, wherein said connecting pin has a cylindrical shape.

17. A process cartridge according to any one of claims 8, 9, and 13, wherein said connecting pin is formed by bending the metal plate into a cylindrical shape, and has opposed edges in a bending direction further bent radially and inwardly thereof.

18. A process cartridge according to any one of claims 8, 9, and 13, wherein a leading portion of said connecting pin in the inserting direction is tapered.

19. A process cartridge according to claim 18, wherein the leading portion of said connecting pin is tapered by drawing or bending.

20. A process cartridge according to any one of claims 8, 9, and 13, wherein said first frame supports said electrophotographic photosensitive drum, charging means for charging said electrophotographic photosensitive drum and cleaning means for removing developer residual on said electrophotographic photosensitive drum after transfer of the latent image from said electrophotographic photosensitive drum.

21. A process cartridge according to any one of claims 8, 9, and 13, wherein said second frame comprises a developing frame supporting a developing member which is said developing means, and a developer frame containing a developer to be supplied to said developing member, said developing frame and said developer frame being welded together.

22. A process cartridge detachably mountable to a main body of an electrophotographic image forming apparatus, said process cartridge comprising:

an electrophotographic photosensitive drum;

developing means for developing an electrostatic latent image formed on said electrophotographic photosensitive drum;

a first frame supporting said electrophotographic photosensitive drum;

a second frame supporting said developing means; and a connecting pin comprising a metal plate made into a hollow shape, and being provided with a slit defined by opposed edges of said metal plate, and having formed on a portion thereof a restraining portion having its trailing end jutting out with its leading end as a bending proximal base in an inserting direction, said connecting pin pivotally connecting said first frame and said second frame together.

23. A process cartridge according to claim 22, further comprising a regulating member for regulating the amount of insertion of said connecting pin in the inserting direction.

24. A process cartridge according to claim 22 or 23, wherein said connecting pin has two restraining portions.

25. A process cartridge according to claim 22 or 23, wherein a leading portion of said connecting pin in the inserting direction is tapered.

26. A process cartridge according to claim 22 or 23, wherein said first frame further supports charging means for charging said electrophotographic photosensitive drum, and cleaning means for removing developer residual on said electrophotographic photosensitive drum, and wherein said second frame comprises a developing frame supporting said developing means, and a developer frame containing the developer to be supplied to said developing means.

27. A process cartridge according to claim 22 or 23, wherein said restraining portion prevents said connecting pin from slipping out of said first frame and said second frame in a direction opposite to the inserting direction.

* * * * *

UNITED STATES PATENT AND TRADEMARK OFFICE

CERTIFICATE OF CORRECTION

PATENT NO. : 6,714,751 B2
DATED : March 30, 2004
INVENTOR(S) : Akira Higeta et al.

It is certified that error appears in the above-identified patent and that said Letters Patent is hereby corrected as shown below:

Column 7,
Line 24, “applied the” should read -- applied to the --.
Line 27, “endure” should read -- endure, --.
Line 28, “out” (second occurrence) should read -- out, --.

Column 9,
Line 57, “become” should read -- becomes --.

Column 11,
Line 3, “producable” should read -- producible --.

Column 12,
Line 28, “arrow “a” ” should read -- arrow “a”, --.

Column 14,
Line 11, “confirmed” should read -- confined --.
Lines 37, 42 and 47, “claims 1,2,” should read -- claims 1 to 3, --.
Lines 38, 43 and 48, “and 3,” should be deleted.

Signed and Sealed this

Fifth Day of April, 2005

JON W. DUDAS
*Director of the United States Patent and Trademark Office*